US006231397B1

(12) United States Patent
de la Borbolla et al.

(10) Patent No.: US 6,231,397 B1
(45) Date of Patent: May 15, 2001

(54) CROSSTALK REDUCING ELECTRICAL JACK AND PLUG CONNECTOR

(75) Inventors: Ian Rubin de la Borbolla, Memphis; Bernard Hammond, Cordova, both of TN (US); Anthony E. Bennett, West Hempstead; Alan M. Sack, Syosset, both of NY (US)

(73) Assignee: Thomas & Betts International, Inc., Sparks, NV (US)

( * ) Notice: Subject to any disclaimer, the term of this patent is extended or adjusted under 35 U.S.C. 154(b) by 0 days.

(21) Appl. No.: 09/293,308

(22) Filed: Apr. 16, 1999

Related U.S. Application Data

(60) Provisional application No. 60/081,985, filed on Apr. 16, 1998, provisional application No. 60/089,477, filed on Jun. 15, 1998, and provisional application No. 60/127,492, filed on Apr. 2, 1999.

(51) Int. Cl.[7] ..... H01R 24/00

(52) U.S. Cl. ..... 439/676; 439/941

(58) Field of Search ..... 439/676, 344, 439/941; 331/1, 12

(56) References Cited

U.S. PATENT DOCUMENTS

| | | |
|---|---|---|
| 2,667,543 | 1/1954 | Smith et al. . |
| 3,757,028 | 9/1973 | Schlessel . |
| 3,761,842 | 9/1973 | Gandrud . |
| 4,157,612 | 6/1979 | Rainal . |
| 4,418,239 | 11/1983 | Larson et al. . |
| 4,473,755 | 9/1984 | Imai et al. . |

(List continued on next page.)

FOREIGN PATENT DOCUMENTS

| | | |
|---|---|---|
| 2 004 346 | 8/1971 | (DE) . |
| 0 421 174 A2 | 9/1990 | (EP) . |
| 0 524 358 A2 | 11/1991 | (EP) . |
| 0 525 703 A1 | 7/1992 | (EP) . |
| 2 212 006 | 12/1989 | (GB) . |
| 2 223 147 | 1/1991 | (GB) . |
| 2 269 941 | 2/1994 | (GB) . |
| 60-98271 | 11/1986 | (JP) . |
| 63-242500 | 3/1990 | (JP) . |
| 5136650 | 6/1993 | (JP) . |

OTHER PUBLICATIONS

Hunt, R.L., Klemczak, R.L., Liu, W. And Nan N., "Automatically Rerouting Wires on Printed–Circuit Boards to Avoid Noise Coupling Problems," *IBM Technical Disclosure*, 18(3):1975.

*Primary Examiner*—Brian Sircus
*Assistant Examiner*—Hae Moon Hyeon
(74) *Attorney, Agent, or Firm*—Hoffman & Baron, LLP

(57) ABSTRACT

An electrical jack and plug connector each reducing crosstalk between signal wires pairs connected to the jack and plug connectors. The jack connector including a plurality of signal carrying elements and a printed circuit board placed adjacent to the signal carrying elements. The printed circuit board includes conductive traces extending from the signal carrying elements. The conductive traces are spaced from each other to form capacitive coupling between the traces and the signal carrying elements. The signal carrying element may include both conductive contacts and conductive paths formed on the printed circuit board. The conductive paths are routed such that capacitive and inductive coupling occurs between signal pair whereby crosstalk is reduced. The plug connector is selectively insertable in the jack and includes a housing in which signal wires may be inserted. Within the plug, the signal wires are routed such that a wire from signal pair cross wires of other signal pairs such that crosstalk is reduced. Both the jack and plug connectors permit the signal pair to remain together upon entering the connector and the signals are rerouted such that the signal at the outputs of the connectors are sequentially arranged for compatibility purposes.

23 Claims, 30 Drawing Sheets

U.S. PATENT DOCUMENTS

| | | | | |
|---|---|---|---|---|
| 4,657,330 | | 4/1987 | Levy . | |
| 4,695,115 | | 9/1987 | Talend . | |
| 4,726,638 | | 2/1988 | Farrar et al. . | |
| 4,772,224 | | 9/1988 | Talend . | |
| 4,799,901 | | 1/1989 | Pirc . | |
| 4,831,497 | | 5/1989 | Webster et al. . | |
| 5,006,822 | | 4/1991 | Reddy . | |
| 5,015,204 | | 5/1991 | Sakamoto et al. . | |
| 5,069,641 | | 12/1991 | Sakamoto et al. . | |
| 5,118,310 | | 6/1992 | Stoede et al. . | |
| 5,139,442 | | 8/1992 | Sakamoto et al. . | |
| 5,178,554 | | 1/1993 | Siemon et al. . | |
| 5,186,647 | | 2/1993 | Denkmann et al. . | |
| 5,226,835 | | 7/1993 | Baker, III et al. . | |
| 5,282,759 | | 2/1994 | Sakamoto et al. . | |
| 5,299,956 | | 4/1994 | Brownell et al. . | |
| 5,326,284 | | 7/1994 | Bohbot et al. . | |
| 5,454,738 | | 10/1995 | Lim et al. . | |
| 5,470,244 | | 11/1995 | Lim et al. . | |
| 5,727,962 | * | 3/1998 | Caveney et al. | 439/344 |
| 5,885,111 | | 3/1999 | Yu . | |
| 5,888,100 | | 3/1999 | Bofill et al. . | |
| 5,911,602 | * | 6/1999 | Vaden | 439/676 |
| 5,971,812 | * | 10/1999 | Martin | 439/676 |
| 5,997,358 | * | 12/1999 | Adriaenssens et al. | 439/676 |
| B1 5,299,956 | | 10/1995 | Brownell et al. . | |

* cited by examiner

CROSSTALK REDUCING ELECTRICAL JACK AND PLUG CONNECTOR

RELATED APPLICATIONS

This application claims priority to copending U.S. Provisional Application Nos. 60/081,985 filed Apr. 16, 1998, 60/089,477 filed Jun. 15, 1998 and 60/127,492 filed Apr. 2 1999.

FIELD OF INVENTION

The present invention relates generally to electrical connectors and, more specifically, to an electrical jack connector and plug connector having reduced crosstalk interference between signal pairs.

BACKGROUND OF INVENTION

Efforts have recently been made to utilize conventional telephone RJ45 jack and plug connectors for data transmission having higher transmission frequencies than is required in voice transmission. The performance criteria for such jack and plug connectors is governed by EIA/TIA standard TSB-40 (connecting hardware specification), Category 5. One aspect of the Category 5 standard is a lower level of near end crosstalk coupling between adjacent contacts of electrical connectors.

Recently, due to higher signal transmission frequencies even more stringent performance criteria have been proposed by EIA/TIA known as Category 6. Category 6 compliant connectors will be required to handle frequency rates of approximately 200 to 250 MHZ. RJ45 connectors presently being marketed fail to meet Category 6 requirements for acceptable levels of crosstalk. An additional performance criteria known as Category 5E has been established for transmission frequencies of 100 MHZ. The acceptable levels of crosstalk are lower then that permitted under Category 5 certification. Accordingly, one aspect of the present invention is to provide an RJ45 connector that will meet or exceed the requirements of Category 5E and Category 6.

Attempts to reduce crosstalk in high frequency connector applications are well known in the art. One common approach has been to modify the connector to simulate the twisting of the signal pairs which occurred in the wiring. This is achieved by crossing over the contacts in away to balance the signals and reduce crosstalk. One such example of this method is shown in U.S. Pat. No. 5,362,257 to Neal et al.

It is known in the art that the capacitive coupling between signal pairs may result in a reduction of crosstalk between same. This relationship between capacitive coupling and reduction of crosstalk is also set forth in PCT publication W094-05092. In general, the introduction of compensatory capacitance between pairs of signals results in the introduction of crosstalk from a signal line of one signal pair to a signal line of a second signal pair which counteracts inherent crosstalk otherwise introduced between the first and second signal pairs, thereby reducing overall crosstalk present on a signal pair.

Additionally, the reduction of crosstalk between adjacent connector conductors in an RJ45 connector is known in the art. A connector having crosstalk reduction is described in U.S. Pat. No. 5,454,738 to Lim et al. and U.S. Pat. No. 5,470,244 to Lim et al. The disclosure of each of these U.S. patents is hereby incorporated by reference. These references disclose an electrical connector including a printed circuit board overlying the contacts thereof having a pair of conductive traces formed on the printed circuit board. The traces are electrically connected to select contacts of the connector. The signal paths of the selected contacts are severed and then rerouted by the traces. The traces form circuit elements which balance mutual inductances for enhanced crosstalk reduction. In addition, each of the traces on the circuit board includes a portion which is in spacial registry with one of the contacts forming a capacitive coupling between the trace and the contact.

The Lim et al. design and those designs relying on inducing capacitance have several limitations. Most notably, the introduction of pure capacitive coupling between signal paths has no significant effect on reducing crosstalk at frequencies above approximately 130 MHZ. Therefore, the designs of the prior art which rely on capacitive coupling are not suitable for Category 5E or 6 applications or those requiring even higher frequency transmission rates.

Other attempts at reducing crosstalk using capacitance are known in the art. U.S. Pat. No. 5,326,284 to Bohbot et al. discloses a wall mounted telecommunications connector including a terminal jack connected to a rigid circuit board. The jack includes contacts each having a corresponding conductor path extending on the board and ending in a terminal block. The circuit board which induces the capacitive coupling includes overlying conductive tabs which are part of the signal paths. The conductive tabs therefore may tend to create stray unwanted capacitance between the tabs and adjacently disposed signal paths. Such stray capacitance is particularly of concern for high frequency, i.e., greater than 100 MHZ, applications as is appreciated by one skilled in the art.

Accordingly, it would be desirable to provide an electrical connector which reduces crosstalk between signal lines for high frequency transmission rates.

SUMMARY OF INVENTION

It is accordingly an advantage of the present invention to provide an electrical jack connector which routes signal paths such that capacitive and/or inductive coupling is induced between signal pairs such that crosstalk is reduced.

It is a further advantage of the present invention to provide an electrical plug connector which routes signal paths such that capacitive and/or inductive coupling is induced between signal pairs such that crosstalk is reduced.

In accordance with a preferred form of the invention, an electrical connector includes a plurality of electrically conductive signal path carrying elements extending from a first end of the connector to a second end of the connector. Each of the signal carrying elements is electrically connected to an input and output termination device. A dielectric substrate is horizontally aligned with the signal carrying elements, and has a first portion extending beyond one of the termination devices. A first conductive trace is formed on the substrate and is conductively connected to one of the signal carrying elements. The first conductive trace extends from the one of the signal carrying elements onto the first portion of the substrate. A second conductive trace is formed on the substrate and is conductively connected to another of the signal carrying elements. The second conductive trace extends from the other of the signal carrying elements onto the first portion of the substrate. A portion of the first conductive trace and a portion of the second conductive trace are spaced a predetermined distance apart by the substrate at a position on the first portion of the substrate to form a mutual capacitive coupling between the first conductive trace and the second conductive trace whereby crosstalk is reduced between the signal carrying elements.

The capacitive coupling between the traces may be positioned on the substrate at a position physically remote from the signal carrying elements.

The individual signal wires may form differential signal wire pairs and each wire of each signal wire pair is positioned adjacent the other wire of the signal wire pair upon connection to the input termination device such that the signal wires are sequentially arranged. The signal carrying elements each include a forward portion forming the output termination which is adapted to be engagable with an element of a plug. The signal carrying elements are routed such that the forward portion of the signal carrying elements carry signals which are sequentially arranged such that the connector is compatible with standardized connection devices.

In an alternative form the present invention may include a connector body and a plurality of signal carrying elements for carrying electrical signals across the connector between input and output termination devices being positioned in the connector body. The plurality of signal carrying elements includes a first and second elongate conductive contacts extending from one end of the connector to another connector end. A dielectric substrate positioned adjacent the plurality of signal carrying elements is provided. The plurality of signal carrying elements further including a first and second signal carrying conductive paths formed on the substrate extending between the input and output termination devices. The first and second signal carrying conductive paths extend across the connector in mutual longitudinally aligned proximity with the first signal carrying conductive path overlying the second signal carrying conductive path whereby the first signal carrying conductive path is capacitively and inductively coupled to the second signal carrying conductive path to such a degree whereby crosstalk is reduced.

In addition, one of the first and second conductive paths may have a width greater then the width of the other of the first and second conductive paths.

In a further embodiment, the plurality of signal carrying elements may include a third and forth conductive contacts and a third and forth signal carrying elements formed on the substrate. The first and second contacts being spaced a distance from third and forth contacts forming a contact free area, the first, second and third and forth signal carrying conductive paths are disposed within the contact free area.

The present invention may further provide a connector including a dielectric plug housing having a first end and a second end. A plurality of signal wires form a plurality of signal pairs, which are disposed within the plug housing. The signal wires longitudinally extending from the first end to the end of the plug. A plurality of conductors is positioned within the plug housing adjacent the first end and electrically connected with the plurality of signal wires. The conductors are arranged in a mutually spaced apart relationship. A first signal wire of the plurality of the signal wires has a first portion extending transversely and crossing over at least one of the plurality of signal wires at a first position located between the second and first ends of the plug such that crosstalk is reduced between the plurality of signal pairs.

The first signal wire may include a second portion extending transversely and crossing back over the second signal wire at a second position located between the first position and the plurality of conductors.

The connector may further include a first wire retainer engagable with the plurality of signal wires, the first retainer maintaining the plurality of signal wires in a predetermined arrangement, and being positioned within the plug housing. A second wire retainer may be included which is engagable with the plurality of signal wires for maintaining the plurality of signal wires in a predetermined arrangement. The first wire retainer is positioned between the first and second signal wire crossing positions and the second wire retainer is positioned between the second signal wire crossing position and the plurality of conductors.

The present invention further provides a jack and plug combination including a jack having a jack body and a plurality of signal carrying elements for carrying electrical signals across the jack positioned in the jack body. The signal carrying elements being routed across the jack such that inductive and capacitive coupling is induced between at least two of the plurality of signal carrying elements to a degree that crosstalk is reduced. A plug including a dielectric plug housing having a first end and a second end, and a plurality of signal wires forming a plurality of signal pairs disposed within the plug housing, The signal wires longitudinally extending from the first end to the end of the plug. The plug further including a plurality of conductors positioned within the plug housing adjacent the first end and electrically connected with the plurality of signal wires. The conductors are arranged in a mutually spaced apart relationship. A first signal wire of the plurality of the signal wires has a first portion extending transversely and crossing over at least one of the plurality of signal wires at a first position located between the second and first ends of the plug such that crosstalk is reduced between the plurality of signal pairs. Whereby, the plug is selectively engagable with the jack such that when the plug is engaged with the jack, crosstalk is reduced in the jack and plug combination to a degree greater than that achieved in the jack and the plug alone.

DETAILED DESCRIPTION OF THE PREFERRED EMBODIMENTS

Figure 1:
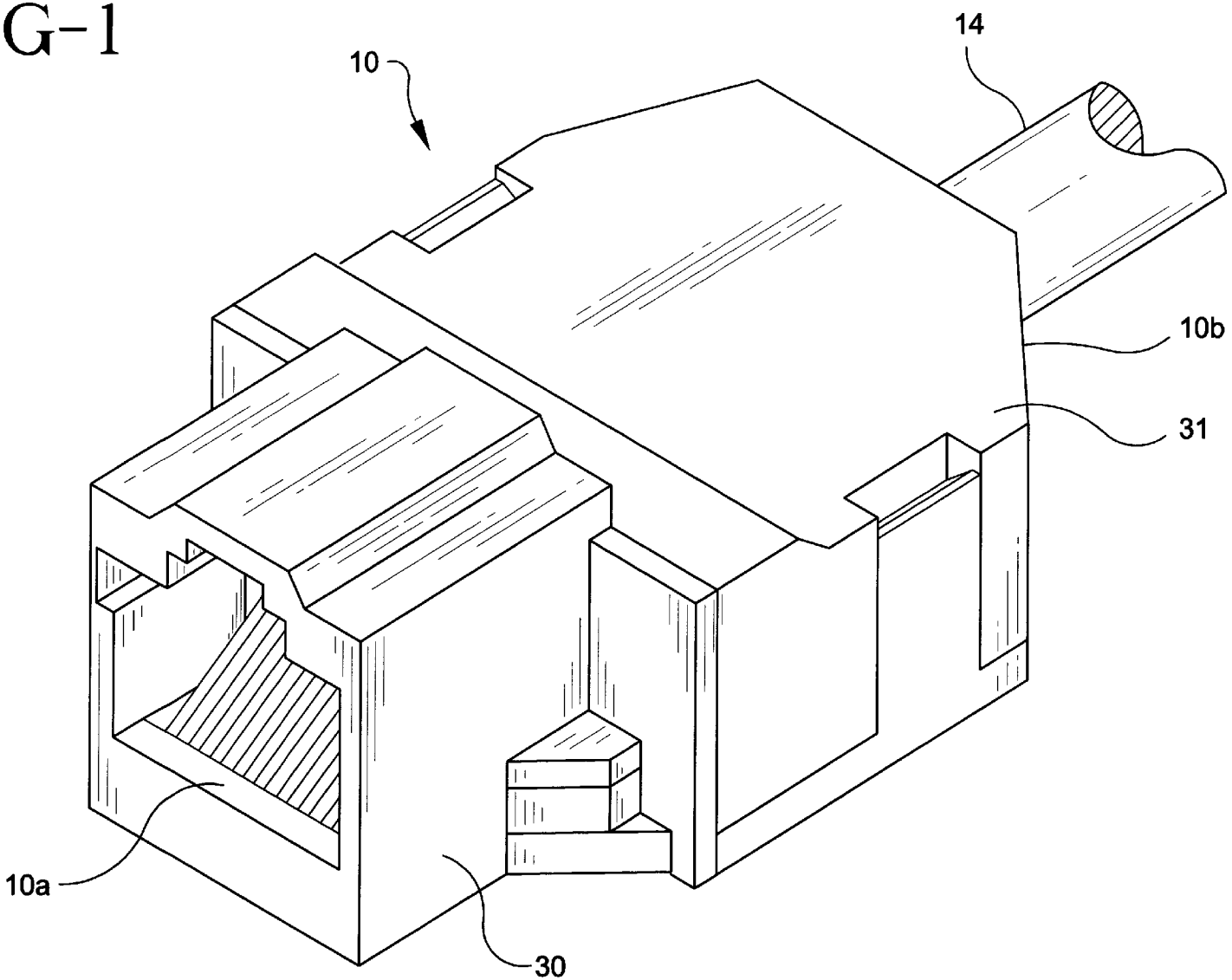
FIG. 1 is top perspective view of the jack connector of the present invention.
Figure 2:
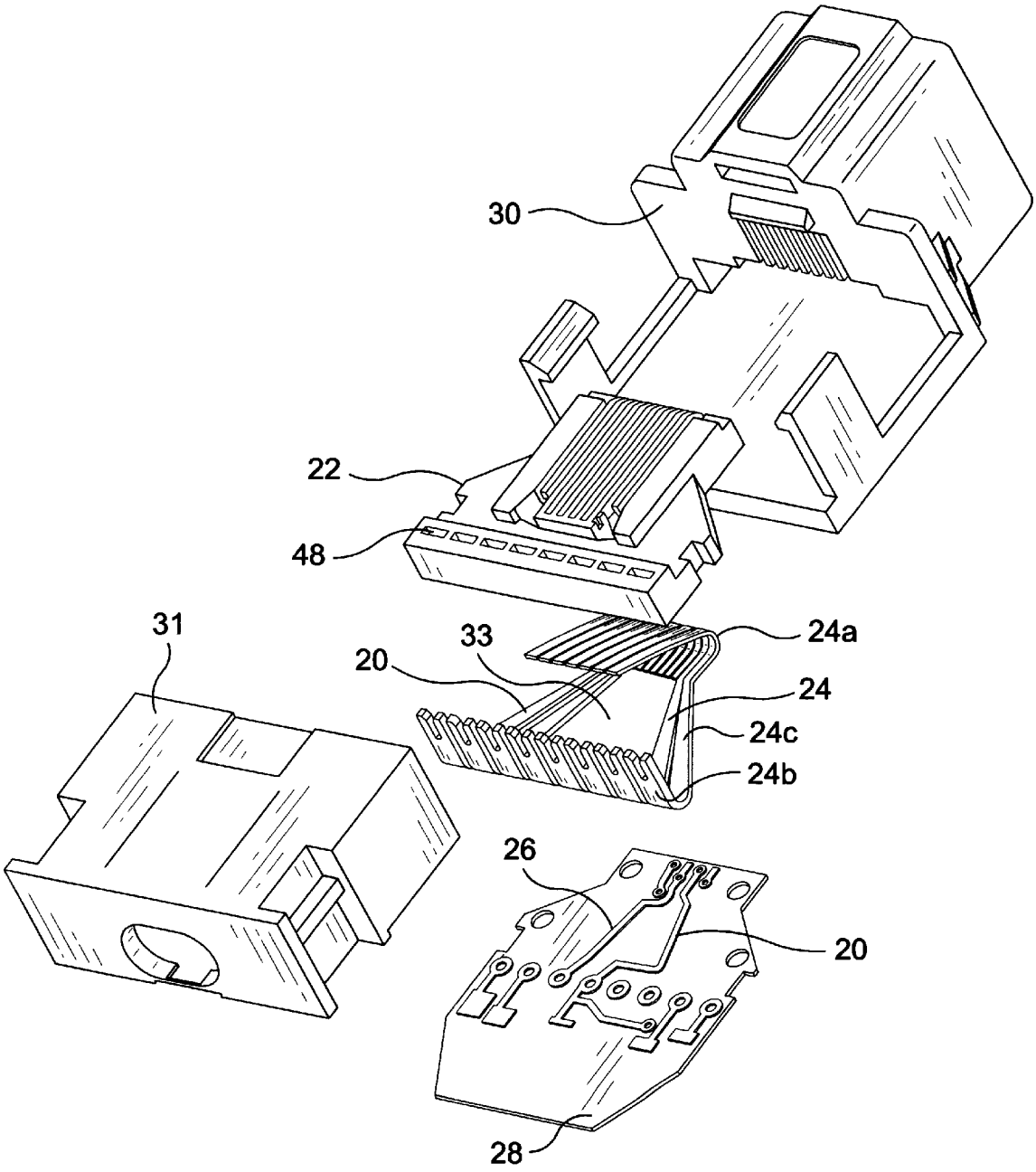
FIG. 2 is an exploded perspective view of the jack of FIG. 1.
Figure 3:
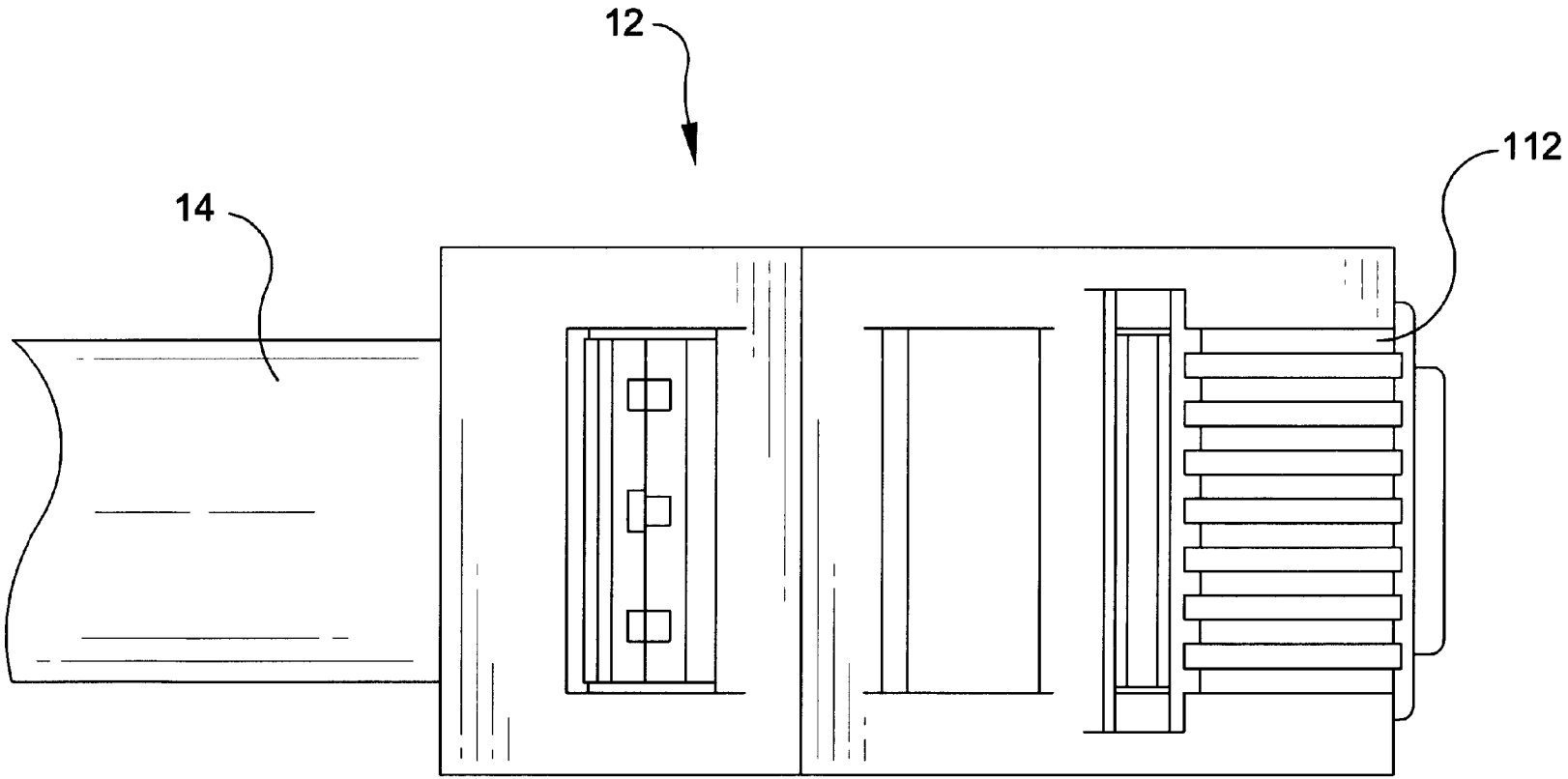
FIG. 3 is a top plan view of the plug connector of the present invention.

The present invention pertains to an electrical connector having crosstalk interference reducing capabilities thereby permitting the transfer of high speed signals such as those required in computer networking applications. Specifically, the present invention includes a jack connector 10 and a plug connector 12. The plug 12 may be inserted within jack 10 forming a connector assembly. In the preferred embodiments, the jack and plug are known in the art as an RJ45 jack 10 and plug 12 as shown in FIGS. 1–3 respectively. However, the present invention contemplates that the crosstalk reducing features of the present invention could be employed in a variety of electrical connectors.

The jack and plug connectors of the present invention are preferably adapted for use with a cable 14 carrying a plurality of signal wires 16 which form signal pairs. Specifically, the jack and plug of the present invention are capable of accommodating eight (8) signal wires forming four (4) signal pairs. Industry standards set forth pair 1 as wires and 2, pair 2 as wires 4 and 5, pair 3 as wires 3 and 6, and pair 4 as wires 7 and 8. The information transmitted over each signal pair is typically a differential signal such that the signal transmitted at any given unit of time is the sum of the voltages between the two wires of the signal pair. Because of the differential nature of the signal, if any stray signal is induced on both of the wires of the pair, then the effects of the stray signal would be canceled out and no crosstalk interference would occur. However, if only one of the wires of the signal pair is subjected to an extraneous signal from one of the other signal pairs then the information carried by the signal pair will be corrupted by what is known as crosstalk interference. Crosstalk is effectively controlled in the lengths of signal wiring by physically twisting together the wires of each signal pair. This ensures that any stray signal induced on one wire of the signal pair will also be induced on the other wire of the pair. However, when the wires are introduced into the connecter, either the plug or jack, the signal wires are untwisted and opportunities for signal degrading crosstalk are presented.

In order to achieve high levels of crosstalk reduction, the present invention controls capacitive and inductive coupling between signal paths. This is achieved by controlling the signal paths as they pass into and across the plug and jack. Accordingly, the jack formed in accordance with the present invention provides crosstalk reducing benefits exceeding the requirements for a Category 5 connector. In addition, the jack and plug of the present invention when mated provide even further reductions in crosstalk.

Specifically, the present invention reduces crosstalk by substantially controlling the capacitive and inductive coupling between the various signal paths. This is based upon principals of transmission line theory. Consider an arbitrary unit length ($\Delta l$) section of a pair of conductors located in close proximity to each other. A signal being carried by one pair of conductors generates electric and magnetic fields. These fields interact with neighboring pair(s) of conductors and induce signals at the terminations. This is referred to as crosstalk. Electromagnetic field theory, and in particular, transmission line theory, can be used to explain the underlying physical phenomena.

In particular, the current of one conductor and the returning current on the other conductor produce a transverse magnetic field. If this $\Delta l$ section of the conductor pair is considered to be a loop, the magnetic flux passing between the conductors links the current of the loop, which may be thought of as an inductance L. Similarly, a transverse electric field results from the separation of charge on the conductor surfaces. This effect may be viewed as a capacitance C. One may, therefore, characterize a $\Delta l$ section of the conductor pair as a transmission line having a lumped capacitance and lumped inductance which are dependent on the distance between conductors and length of the conductors respectively. Accordingly, by controlling the length over which signal paths run adjacent to each other, the amount of signal induced, or coupled, between signal paths can be controlled.

In the present invention, this coupling is preferably achieved by routing the various signal paths across the plug 12 and jack 10 such that the length with which two signal paths run adjacent to each other is controlled to reduce crosstalk. Assume signal pair 1 has signal paths A and B associated therewith and signal pair 2 has signal paths C and D associated therewith. The signal paths of any one signal pair (e.g., A-B or C-D) carry a balanced or differential signal component that is 180 degrees shifted in phase from each other. Because of this arrangement, any noise induced on one signal path of a particular signal pair will also be induced on the other adjacent path in equal magnitude but 180 degrees out of phase, such that the noise component of a signal passing across that signal pair will be arithmetically canceled.

As an example, if signal path B of signal pair 1 runs adjacent to signal path C for a distance x then either B must run adjacent to D for a distance x or A must run adjacent to C for a distance x. In the first case, B running adjacent to D, since C and D are 180 degrees out of phase any signal induced on B by C will be canceled by D. In the second case, A running adjacent to C, any signal induced onto B by C will be equally induced on A, and since A and B are pairs carrying differential signals any influence of the emitted C signal will be negated.

Figure 4:
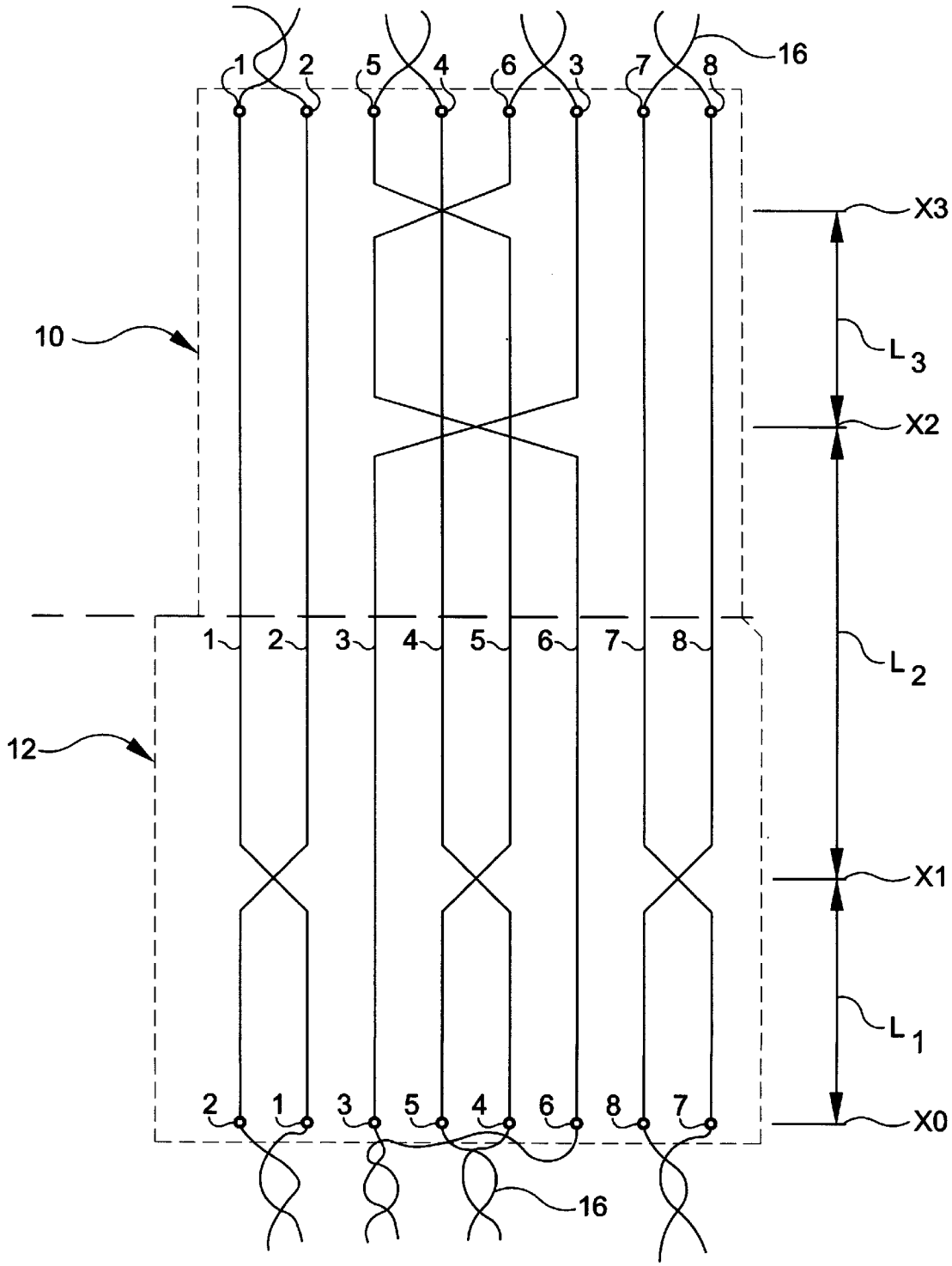
FIG. 4 is a schematic representation of the signal paths extending across the plug and jack.
Figure 5:
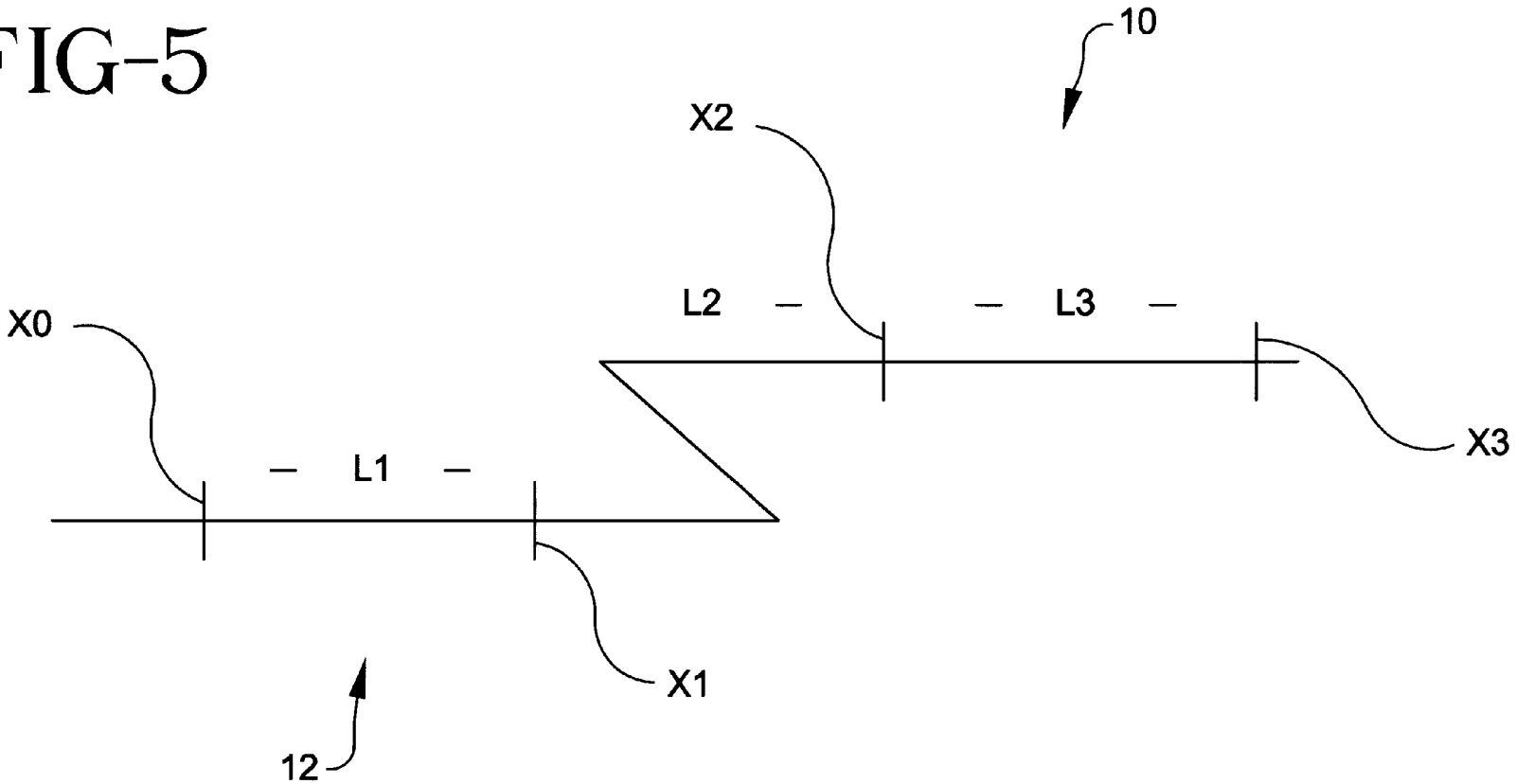
FIG. 5 is a schematic view of the various lengths of the plug and jack.
Figure 6:
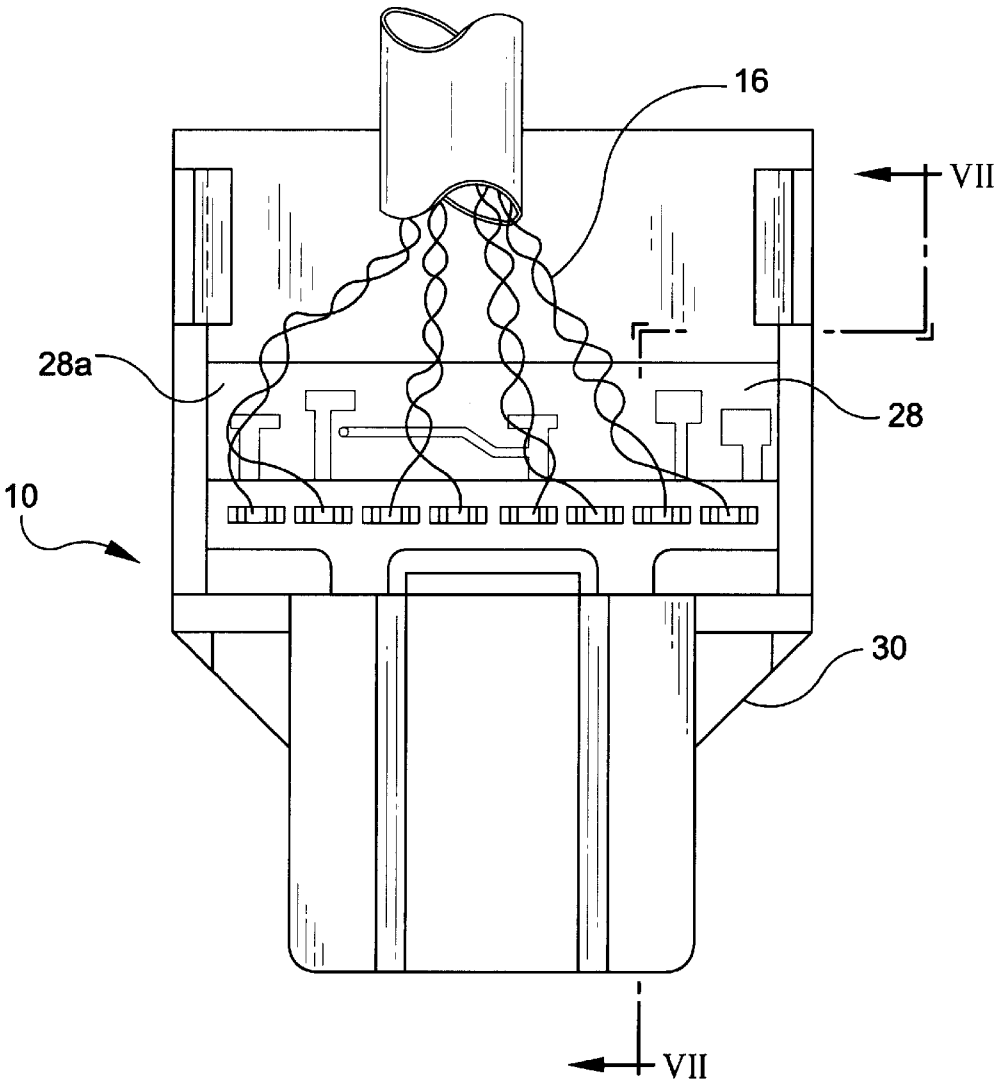
FIG. 6 is a top plan view of the jack of the present invention showing the signal wires connected thereto and the wiring cover removed.

An illustrative embodiment of the signal path routing illustrating both of the crosstalk reducing methods is shown schematically in FIGS. 4 and 5. As illustrated, the wiring entering both jack 10 and plug 12 permits the signal pairs to remain together. The length of the signal paths are also balanced across the jack and plug such that the coupling between signal paths is matched.

With specific reference to FIG. 4, the following example explains how the coupling between signal paths is achieved in the preferred embodiment in order to reduce crosstalk. Going from the plug to the jack, signal path 3 extends a distance L1 adjacent signal path 1. After signal paths 1 and 2 cross, signal path 3 then runs next to signal path 2 for a distance L2 which is greater than L1. Signal path 3 then crosses with signal path 6 resulting in signal path 6 running adjacent signal path 2 for a distance L3. Distance L1+L3=L2, therefore, any induced signal from signal path 1 onto 3 is canceled by running signal path 3 adjacent 2 and any induced signal from signal path 2 onto 3 is canceled by running signal path 6 adjacent 2. This balancing of the coupling between signal paths preferably applies to signal path 6 as well as all the other signal paths in order to prevent crosstalk. Accordingly, the present invention uses both the plug and jack to achieve reductions in crosstalk such that signals having frequencies of 250 MHZ may be transmitted with crosstalk being controlled to acceptable levels.

The above described illustrative embodiment presupposes that the coupling per unit length is uniform. If this is not the case, then the lengths over which signal paths must run adjacent to one another may be varied in order to cancel any induced signals.

The ability to equally match the lengths between signal paths may not be possible due to the physical constraints of the standard RJ45 plug and jack. Therefore, in order to compensate for any mismatch between signal path lengths, capacitance and or inductance may be added between affected signal paths in order to achieve a further reduction in crosstalk. The precise magnitude of capacitive coupling may be adjusted in order to tune the connector to achieve the desired reduction of crosstalk for a given range of frequencies.

In addition, the connector assembly of the present invention reduces crosstalk by maintaining the signal wires 16 of each signal pair in physical proximity as they enter jack 10 and plug 12. It has been found that a major factor leading to crosstalk at the connector is due to the manner in which the signal wiring is introduced into a plug and jack. The signal wiring typically includes four twisted pairs, each pair carrying a differential signal with one wire of the pair being 180 degrees out of phase with the other wire of the pair. As stated above, pair 1 includes wires 1 and 2, pair 2 wires 4 and 5, pair 3 wires 3 and 6, and pair 4 wires 7 and 8. In prior art devices, the twisted signal pair 3 and 6 are physically separated when put into the jack and plug in order to maintain the sequential arrangement of signal wires, i.e., 1, 2, 3, 4, 5, 6, 7, and 8. However, when these signal paths are separated, stray signals emitted from the adjacently disposed signal paths, such as wire 4 or 5, may be coupled onto either signal path 3 or 6, thereby introducing crosstalk.

In addition to routing the signal paths to obtain beneficial capacitive and inductive coupling and adding capacitive coupling between signal paths, the present invention substantially overcomes the crosstalk problem which exists in prior art connectors by introducing the twisted pairs into jack 10 and plug 12 without separating the signal pairs until signal wiring has entered jack 10 or plug 12. It is desirable to maintain the signal pairs together over as great a distance as possible since any stray signal will be induced equally on the wires which make up the signal pair, and due to the differential nature of the signal pairs, such induced crosstalk will be substantially canceled.

Two preferred embodiments of jack 10 formed in accordance with the present invention are shown in FIGS. 1, 2 and 6–14. Referring specifically to FIGS. 1, 2 and 6–9, jack 10 may be an RJ45 telecommunications type jack which is directly connectable to individual signal wires 16 covered by and running within an outer insulator 18. The jack is capable of accommodating eight (8) signal wires at a back end and an RJ45 plug at the front end. Jack 10 includes a plurality of electrically conductive signal carrying elements 20 forming signal paths which carry the signal across jack 10. The signal carrying elements 20 preferably include a mix of discrete conductive contacts and conductive paths formed on a dielectric substrate as will be described below.

Figure 7:
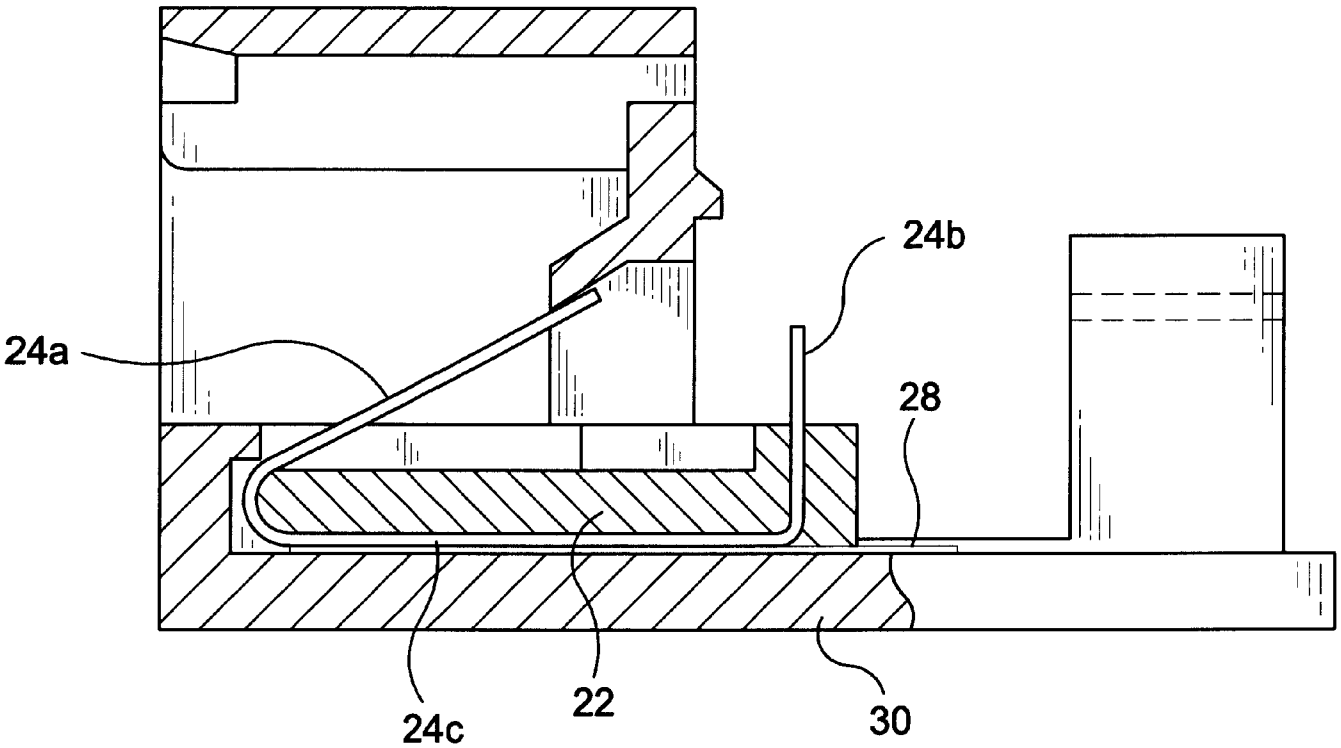
FIG. 7 is a partial side cross sectional view of the jack of FIG. 6 taken along line VII—VII thereof
Figure 8:
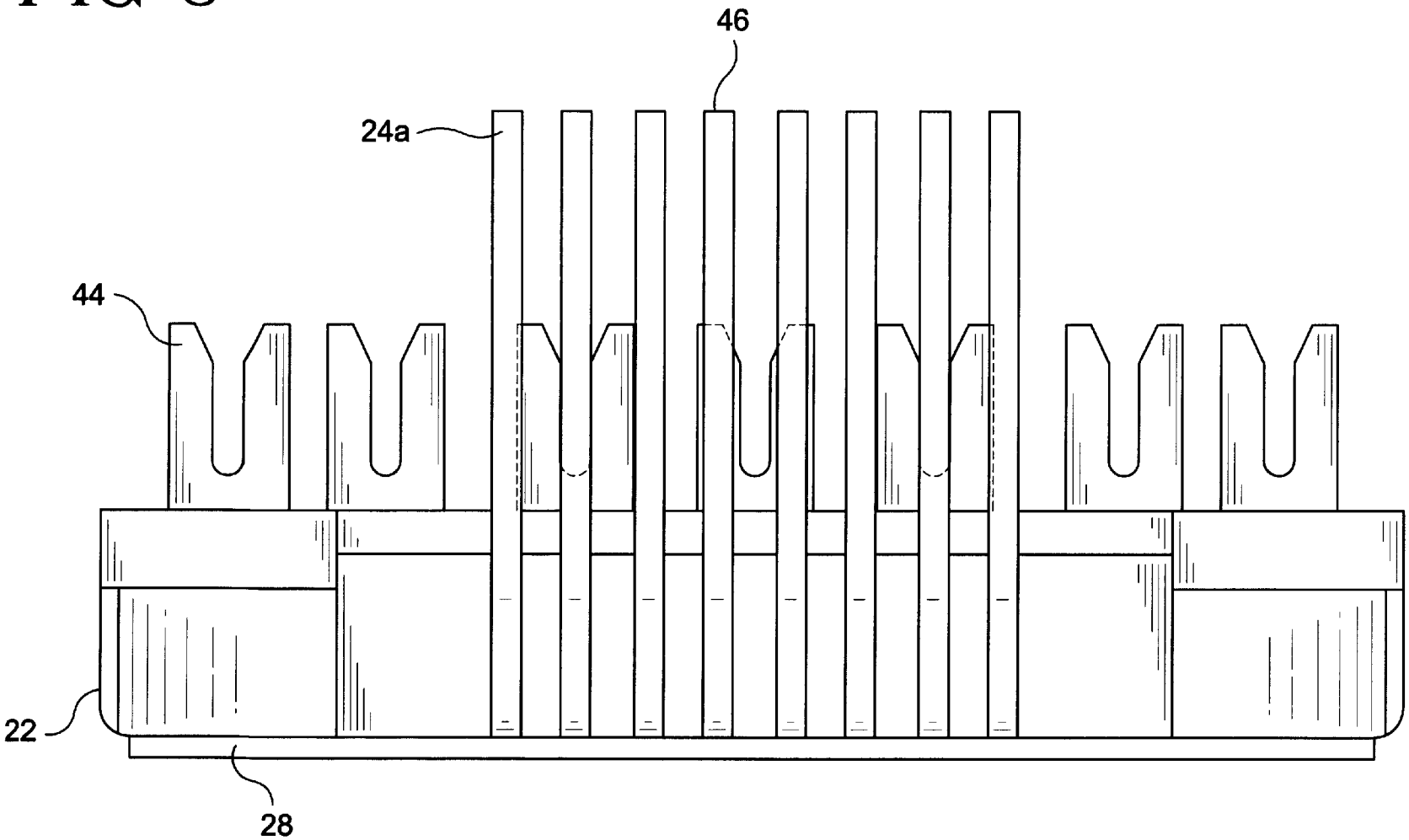
FIG. 8 is an end view of the contact housing and printed circuit board of FIG. 1.

Now referring specifically to FIGS. 1, 2 and 7, jack 10 comprises an insulative contact housing 22 supporting a plurality of spaced contacts 24 thereon in side-by-side arrangement. Contacts 24 are preferably discrete members formed of a conductive material. Conductive paths 26 are formed on a printed circuit board ("PCB") 28 which is disposed beneath contact housing 22. Contact housing 22 and PCB 28 are securably positioned within a dielectric jack body 30. Each contact 24 includes a forward terminal portion 24*a* formed in cantilevered fashion to make electrical connection to complimentary contacts of an RJ45 plug connector. Each contact 24 further includes a rearward terminal 24*b* preferably in the form of an insulation displacement contact ("IDC") for electrical connection with conductors of insulated signal wires 16. Between each forward terminal 24*a* and rearward terminal 24*b*, each contact includes a transition portion 24*c* having a generally rectangular cross section and having a substantially flat surface area between the forward and rearward terminals. The flat transition portions which are formed to make pitch transition between the pitch of the IDC rearward terminals 24*b* and the cantilever forward terminals 24*a* are supported on the contact housing 22 in laterally spaced disposition and such that the flat surfaces of the transition portions 24*c* lie substantially in a common plane. A wiring cover 31 which is selectively engagable with jack body 30 may be included to enclose and protect the signal wiring terminations.

Figure 9:
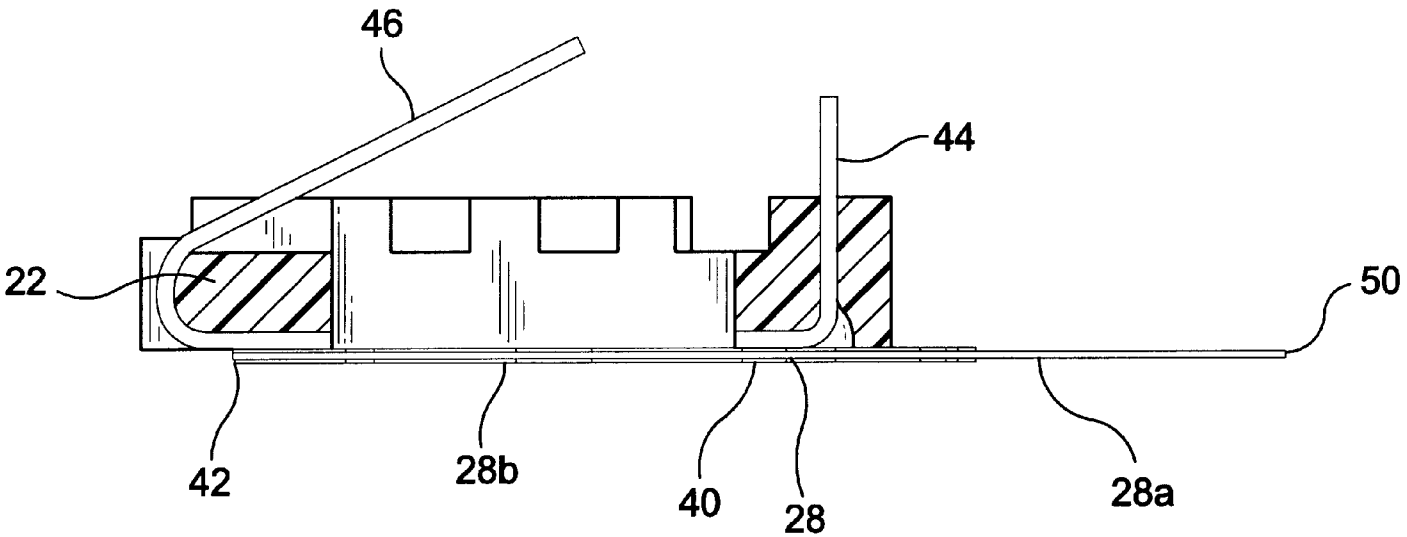
FIG. 9 is a side cross sectional view of the contact housing and printed circuit board shown in FIG. 8.
Figure 10:
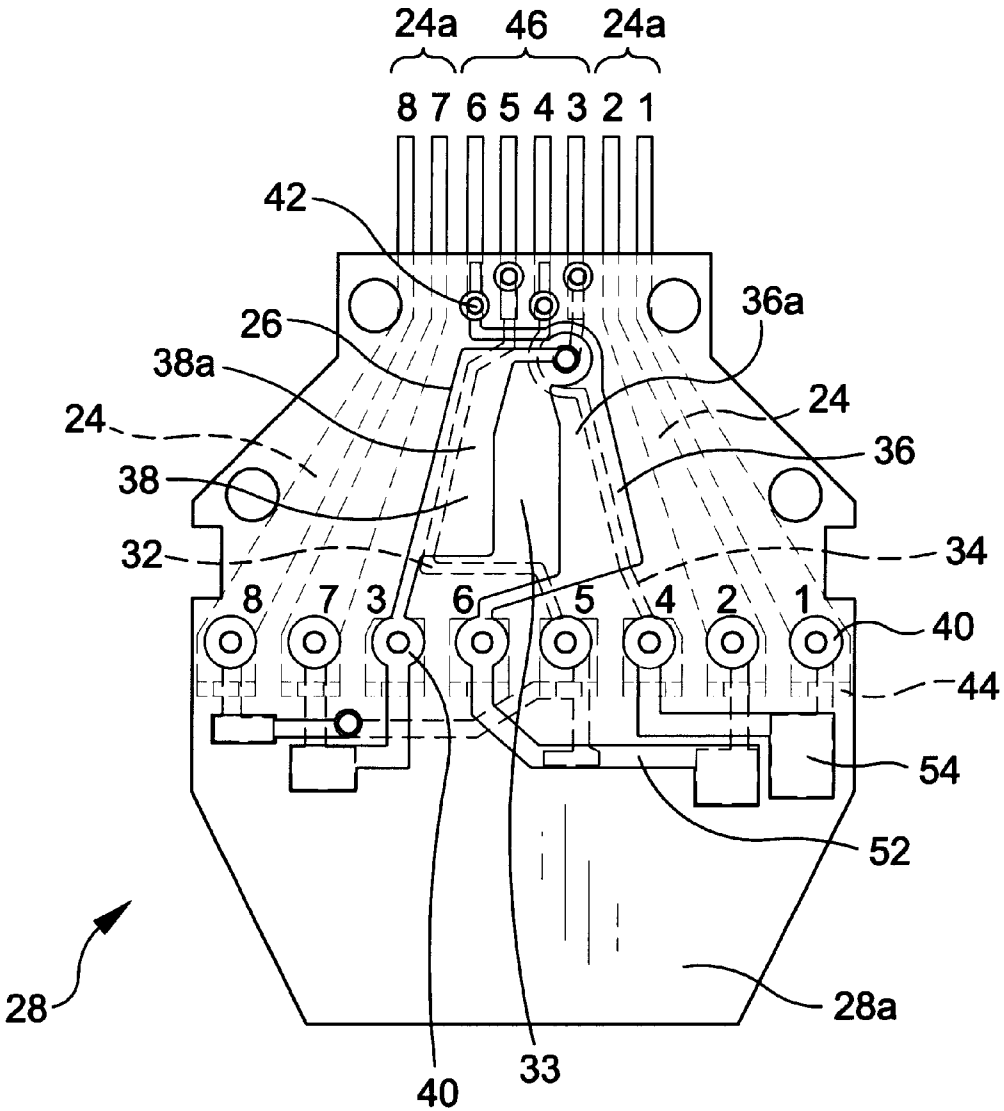
FIG. 10 is a bottom view of the first preferred embodiment showing the circuit board attached to contacts.

Unlike a standard RJ45 jack which typically includes 8 contacts, one for each signal wire, jack 10 of the present invention preferably includes only four (4) contacts 24 which form four of the eight signal paths. The four remaining signal paths are formed by conductive paths 26 formed on PCB 28. The various signal paths referred to herein are associated with a number which corresponds to the signal wire number to which it is conductively connected. With further reference to FIGS. 9–12, contacts 24 are disposed within jack 10 as two spaced pairs and carry signals 1, 2 and 7, 8. The two pairs of spaced contacts form a contact free area 33. Conductive paths 26 are disposed between the spaced contact pairs in the contact free area 33 and carry signals 3, 4, 5, and 6. The conductive paths 32 and 34 are preferably formed on the top surface of the PCB, i.e., the surface which abuts the bottom of the contact housing and forms signal paths 5 and 4, respectively. Paths 32 and 34 are essentially thin linear elements. Two additional conductive paths 36 and 38 are formed on the bottom surface of PCB 30 and preferably form signal paths 6 and 3. Paths 36 and 38 each have an enlarged intermediate portion 36*a* and 38*a* formed in the central region of PCB as shown in FIG. 10. Paths 32 and 38 are routed such that they are in mutual longitudinally aligned proximity. Paths 34 and 36 are also routed on the PCB such that they are in mutual longitudinally aligned proximity. Accordingly, based on the principles set forth above, capacitive and inductive coupling is introduced by the overlying signal carrying conductive paths 32, 38, and 34, 36 such that coupling exists between signal paths 3 and 5, and 4 and 6. Use of conductive paths formed on a PCB permits a precise degree of capacitive and inductive coupling to be introduced between selected signal paths in a precise and reliable manner.

Conductive paths 32, 34, 36 and 38 each extend from a corresponding weld point 40 formed adjacent the row of insulation displacement connections ("IDC's") 44 to a corresponding weld point 42 located near the front of PCB 28. Weld points 40 are each mechanically and electrically secured to a separate IDC 44 (see FIG. 9.) The IDC 44 provide the electrical connection between signal wires 16 and corresponding conductive paths 26. For contacts 24, the corresponding IDC which forms the rearward terminal portion 24*b* of the contact is preferably formed integrally with the contact. The IDC's which are connected to the conductive paths are preferably individual elements welded to PCB 28. The IDC's form input termination devices of the jack. Weld points 42 connect the conductive paths to conductive forward terminal cantilevered contacts 46 which are similar to the contact forward terminal portions 24*a* reference above. Forward contacts 46 and 24*a* form output termination devices of the jack. Forward contacts 46 extend from the forward end of paths 32, 34, 36 and 38 and curve upwardly to form finger-like projections (see FIG. 9) which engage conductive elements in the plug. In addition, contacts 24 are each preferably secured to PCB 28 by weld point 40.

It is to be appriciated that the terms "input" and "output" as used above are intended for positional description only and are not meant to refer to the electrical characteristics of the connector. Jack 10 is of a type where data signals can travel in both directions across the jack.

PCB 28 is preferably secured to the contact housing 22 by the IDC's 44, which are attached to PCB 28. The IDC's extend through slots 48 (FIG. 2) in the contact housing between which there is an interference fit. In addition, as shown in FIG. 9, the forward contacts 24*a* and 46 when bent over tend to secure PCB 28 to contact housing 22.

The first preferred embodiment of jack 10 permits the paired signal wires 16 to remain together up until securement to the IDC's which assists in reducing crosstalk in the connector. Accordingly, signal wires 16 are not sequentially arranged when they are placed in IDC's 44. It is important for compatibility purposes that the signal paths at the plug receiving end 10*a* of the jack to be sequentially arranged, 1–8. Therefore, the signal carrying conductive paths 32, 34, 36 and 38 are routed to cross one another as they extend across PCB 28 such that the forward contacts 24*a* and 46 carry the signals in a sequential manner. The use of conductive paths on the PCB greatly enhances the ability to easily route the signal paths so that the most beneficial routing can be achieved in a feasible manner.

PCB 28 not only contains signal carrying conductive paths, but also supports traces which capacitively couple the various signal paths to each other in order to achieve crosstalk reducing benefits. As shown in FIG. 9, circuit board 28 preferably includes a rearward portion 28*a* which extends beyond the contacts rear portion 24*b*, and a forward portion 28*b* which is disposed beneath contact transition portions 24*c* and conductive paths 26. PCB 28 is preferably a two-sided board and includes a dielectric substrate 50 supporting thereon several conductive paths and traces formed on both the top surface and bottom surface of the two-sided circuit board.

Capacitive coupling between signal paths is formed by portions of the traces acting as overlying parallel plates formed on opposite sides of the PCB. In principle, capacitance between parallel plates is basically a function of (1) the area A of the plates, (2) the distance D between the plates, and (3) the dielectric constant K of the dielectric material between the plates. Such capacitance in picofareds (pF), may be calculated using the equation:

$$C=(0.2249A/D)K$$

Desirable amounts of capacitive coupling may be achieved by using a set of conductive traces 52 which end in tabs 54 formed on opposite sides of PCB 28 which acts as a dielectric. The induced capacitance also assists in countering the parasitic capacitance which occurs between the adjacently disposed conductive plates held within plug 12.

Figure 11:
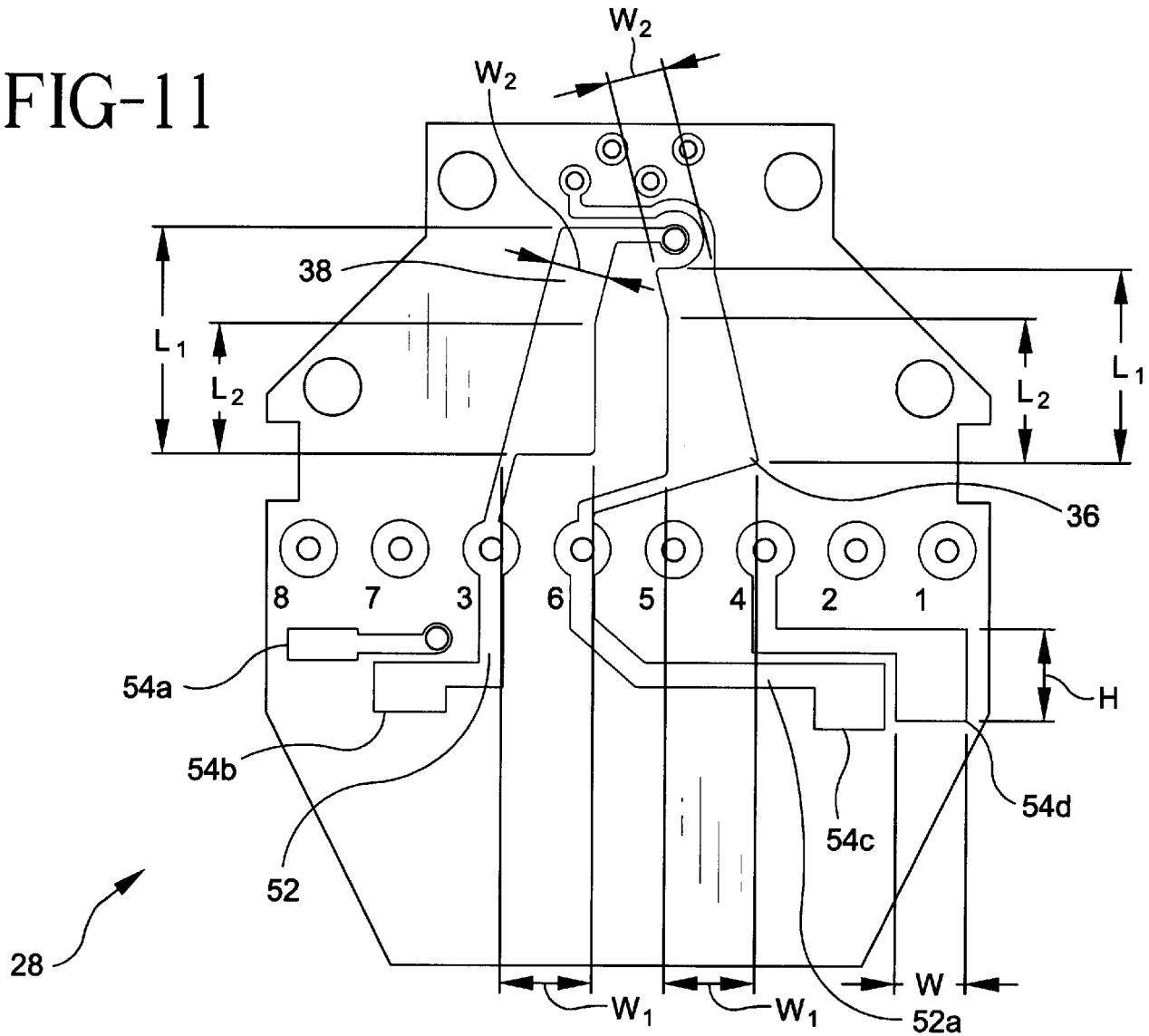
FIG. 11 is a bottom view of the printed circuit board of FIG. 10.
Figure 12:
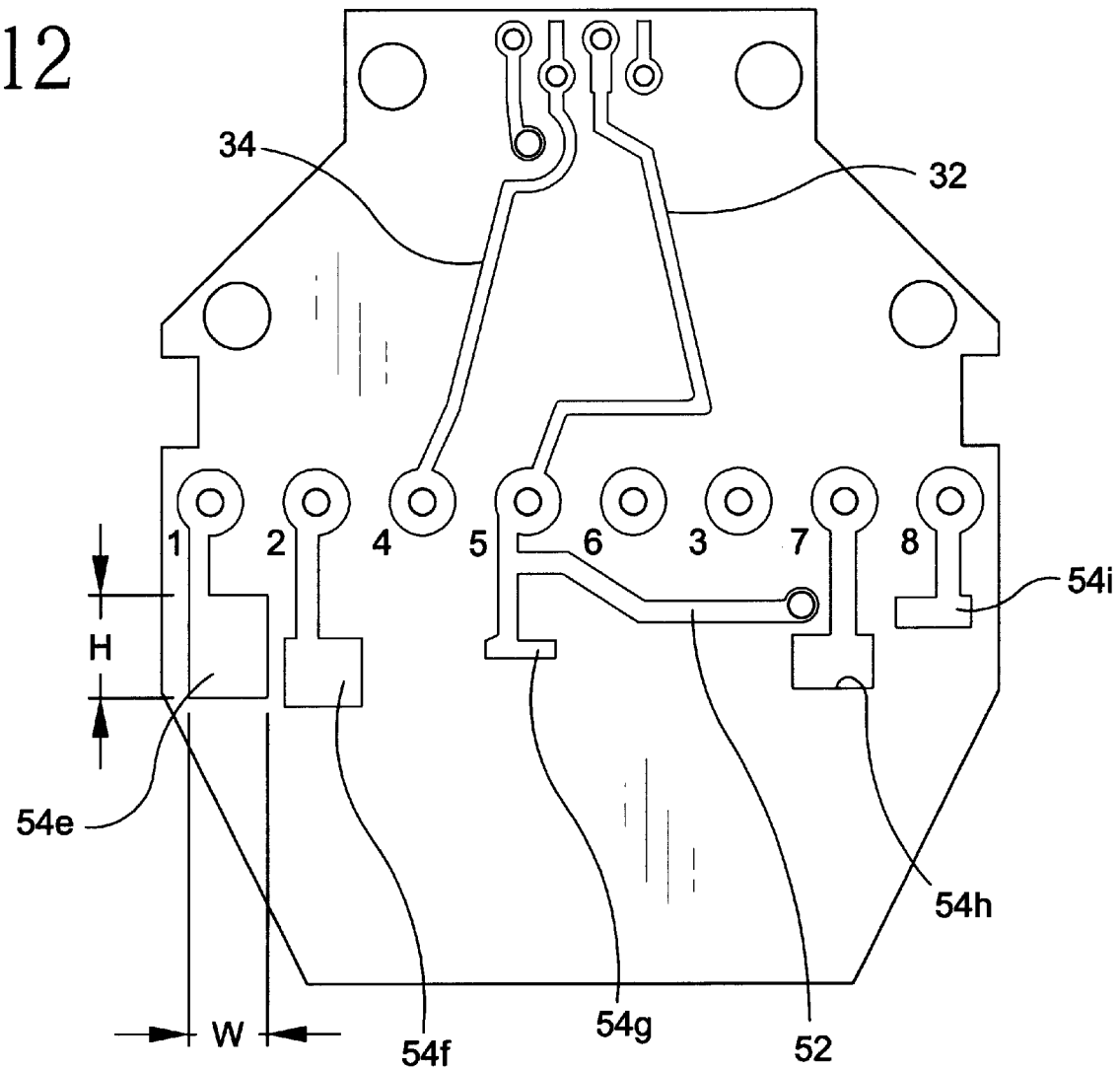
FIG. 12 is a top view of the printed circuit board of FIG. 10.

The first preferred embodiment shown in FIGS. 10–12 introduces capacitive coupling between the signal paths by overlying conductive traces 52 and tabs 54 formed behind the IDC's 44, as well as by the overlying signal carrying conductive paths 32, 34, 36 and 38. Capacitive coupling between signal paths 1 and 4, 2 and 6, 2 and 5, 5 and 6, 5 and 8, and 3 and 7 is achieved by way of conductive tabs 54 and trace portions 52*a* formed on opposite sides of PCB rearward portion 28*a* behind the IDC's. The design of the present invention permits the size of overlying traces 52 and tabs 54 to be formed in a wide variety of shapes and sizes thereby permitting the precise degree of capacitive coupling to be achieved resulting in the maximum reduction of crosstalk as desired. In addition, introducing the capacitance between signal paths at the rearward portion 28*a* of the PCB 28 isolates the capacitance forming tabs from the signal carrying elements 20 such that stray capacitances and unwanted coupling between signal paths can be avoided.

In order to achieve the desired levels of crosstalk reduction tabs having the following height, H, and width, W, dimensions may be employed:

| Figure 11 | | | Figure 12 | | |
|---|---|---|---|---|---|
| TAB | Height H (In) | Width W (In) | TAB | Height H (In) | Width W (In) |
| 54a | .030 | .072 | 54e | .088 | .070 |
| 54b | .045 | .075 | 54f | .060 | .065 |
| 54c | .065 | .075 | 54g | .013 | .065 |
| 54d | .093 | .080 | 54h | .040 | .065 |
| | | | 54i | .025 | .062 |

In addition, conductive path central portion 36*a* may have a length, $L_1$, of approximately 0.214 in. and a length, $L_2$, of 0.169 in. Over the length $L_2$, the path 36*a* tapers in width from $W_1$ of 0.100 in. to $W_2$ of 0.060 in. Conductive path central portion 38*a* has a length, $L_1$, of approximately 0.240 in. and a length, $L_2$, of 0.140 in. Over the length $L_2$, the path 38*a* tapers in width from $W_1$ of 0.097 in. to $W_2$ of 0.060 in.

Additional dimensional information can be obtained from FIGS. 11 and 12 which show to scale the bottom and top of PCB 28, respectively. These dimensions are meant to be illustrative and are not intended to be limiting.

By eliminating the four central contacts and instead utilizing conductive paths, several advantages are obtained. One particular advantage is that the capacitive coupling and inductance between the overlying signal carrying paths 26 can be precisely controlled. Such control is possible since the distance between the conductive paths is essentially fixed by the thickness of the PCB. Controlling the distance between overlying paths is important since the distance directly influences the resulting capacitance. In contrast, by placing a conductive trace on a PC board in spacial registry with a contact as taught in the prior art, the distance between the conductive trace and the contact may vary due to manufacturing tolerances. Any such spacial inaccuracies are overcome by the present invention. Furthermore, using conductive paths formed on a PCB increases design flexibility since the shape and size of the path may be easily altered to create a desired capacitance and inductance. In contrast, altering the size and shape of a contact would be impractical.

This embodiment of jack 10 has been tested to comply with the Category 6 link and channel standard for reducing crosstalk when used with the preferred embodiment of the RJ45 plug which is set forth below. Attenuation and return loss characteristics also meet the Category 6 link and channel requirement. The jack 10 used with a standard RJ45 plug has been tested to meet the Category 5E requirements.

A second preferred embodiment of jack 10 is contemplated by the present invention. This embodiment exceeds the Category 5 requirements for crosstalk reduction between signal paths and meets the testing criteria for Category 5E. This embodiment is substantially similar to the first preferred embodiment described above with the exception to the layout of the PCB 28' shown in FIGS. 13 and 14. Signal carrying conductive paths 32' and 34', which carry signals 4 and 5 respectively, are formed on the top side of the board and are substantially similar to paths 32 and 34 described above. Conductive paths 36' and 38' formed on the bottom of the PCB, which carry signals 6 and 3 respectively, have a portion which lies in mutual longitudinally aligned proximity with paths 32' and 34', respectively in order to capacitively and inductively couple the corresponding signal paths.

As in the first preferred embodiment, the paired signal wires 16 may remain together until securement to the IDC's. Conductive paths 32', 34' 36' and 38' are routed as they extend across PCB 28' such that the forward contacts 24*a* and 46 carry the signals in a sequential manner.

However, unlike the first preferred embodiment there is no conductive coupling between signal paths 5 and 6 due to the removal of a tab 54*g*. In addition, the size of the conductive paths central portions 36*a'* and 38*a'* for signal paths 6 and 3 are not as wide as the central portions of the first preferred embodiment shown in FIG. 10. Furthermore, the size of the conductive tabs 54' formed behind the IDC's also differs thereby creating a difference in capacitive coupling and corresponding crosstalk reduction. The change in size and shape of the paths and traces tends to affect the capacitive and inductive coupling between the signals resulting in differing degrees of crosstalk reduction.

Figure 13:
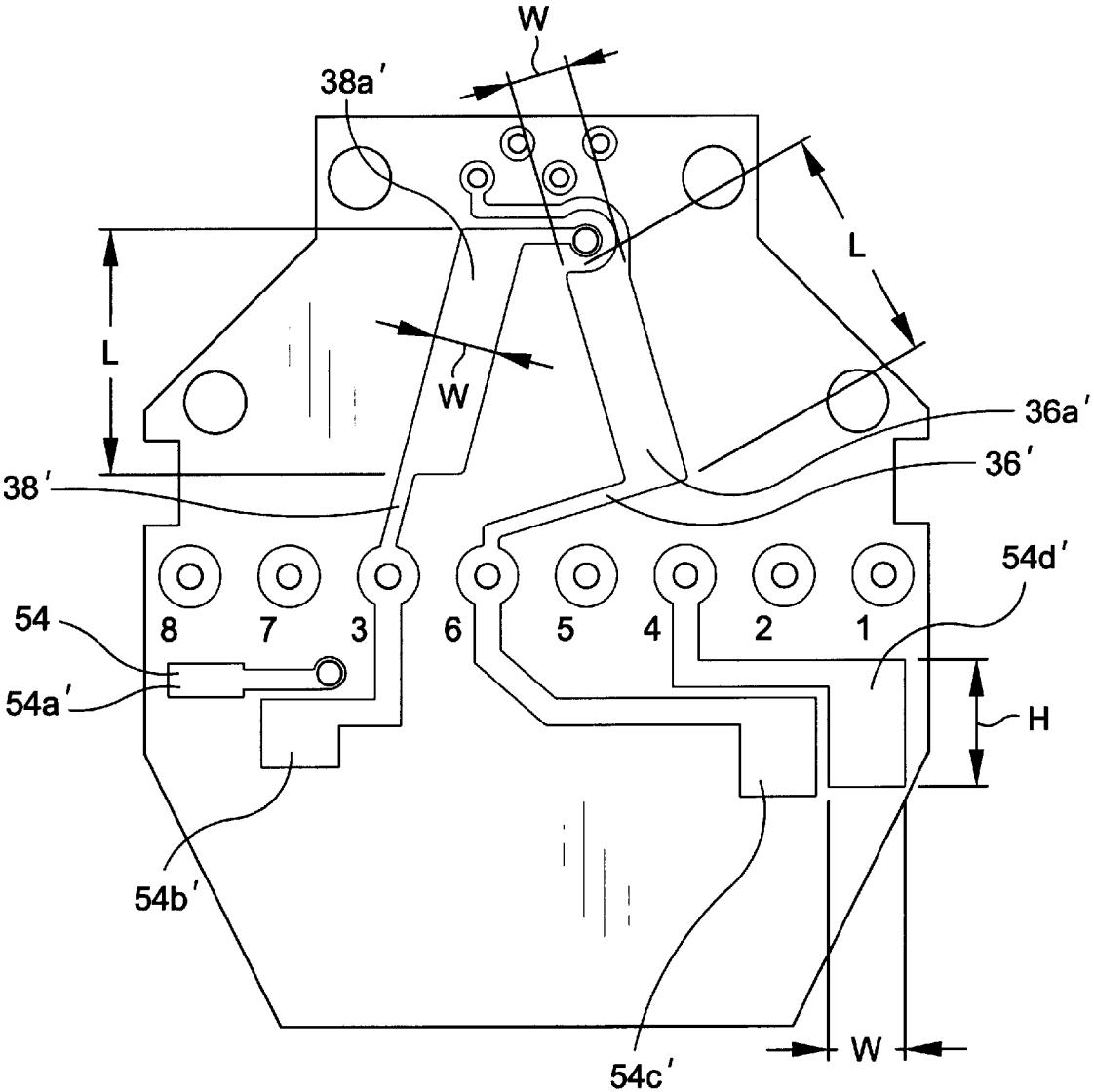
FIG. 13 is a bottom view of a second preferred embodiment of the printed circuit board of the present invention.
Figure 14:
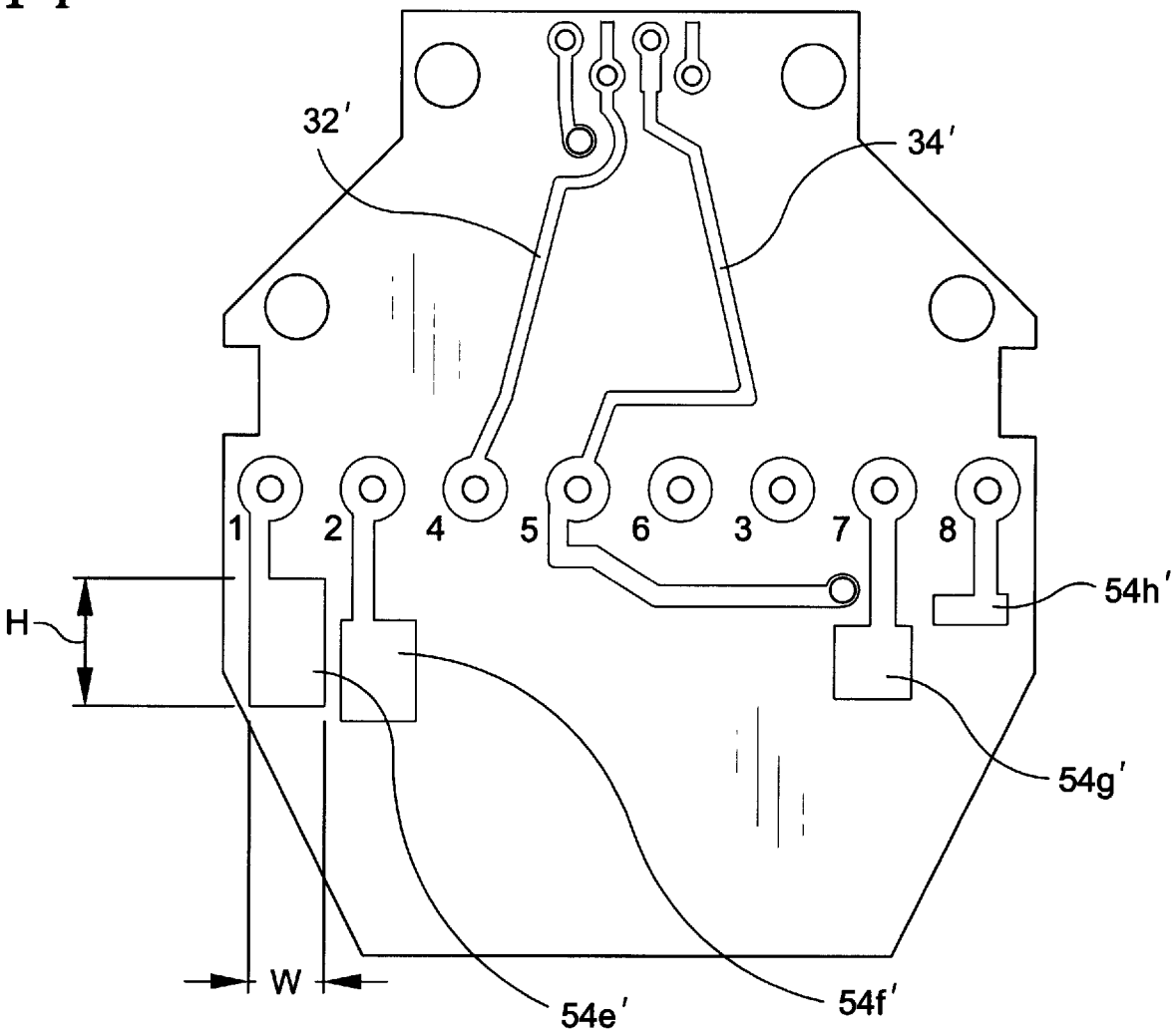
FIG. 14 is a top view of the printed circuit board of FIG. 13.

In order to achieve the desired levels of crosstalk reduction tabs having the following dimensions may be employed:

| Figure 13 | | | Figure 14 | | |
|---|---|---|---|---|---|
| TAB | Height H (in.) | Width W (in.) | TAB | Height H (in.) | Width W (in.) |
| 54a' | .038 | .072 | 54e' | .119 | .070 |
| 54b' | .071 | .075 | 54f' | .099 | .065 |
| 54c' | .104 | .075 | 54g' | .066 | .065 |
| 54d' | .124 | .080 | 54h' | .033 | .062 |

In addition, conductive path central portion 36*a'* has a length, L, of approximately 0.232 in. and central portion 38*a'* has an approximate length, L, of 0.240 in. Both central portions have a width, W, of approximately 0.060 in.

Additional dimensional information can be obtained from FIGS. 13 and 14 which show to scale the bottom and top of PCB respectively. These dimensions are meant to be illustrative and are not intended to be limiting.

In the two preferred embodiments, printed circuit boards 28 and 28' are preferably a flexible type formed of Kapton having a thickness of 0.005 inches. The conductive traces are preferably formed of copper having a plating of 10/60 lead tin solder and have a thickness of approximately 0.003 inches. The PCB's may be formed in accordance with known circuit board manufacturing techniques.

The present invention permits a variety of connector embodiments, each having specific crosstalk reducing capabilities, to be easily designed due to the flexibility inherent to a PCB based design. Further alternative embodiments of connectors having signal carrying elements formed of conductive paths formed on a PCB and discrete contacts are shown in FIGS. 15–18.

Figure 15:
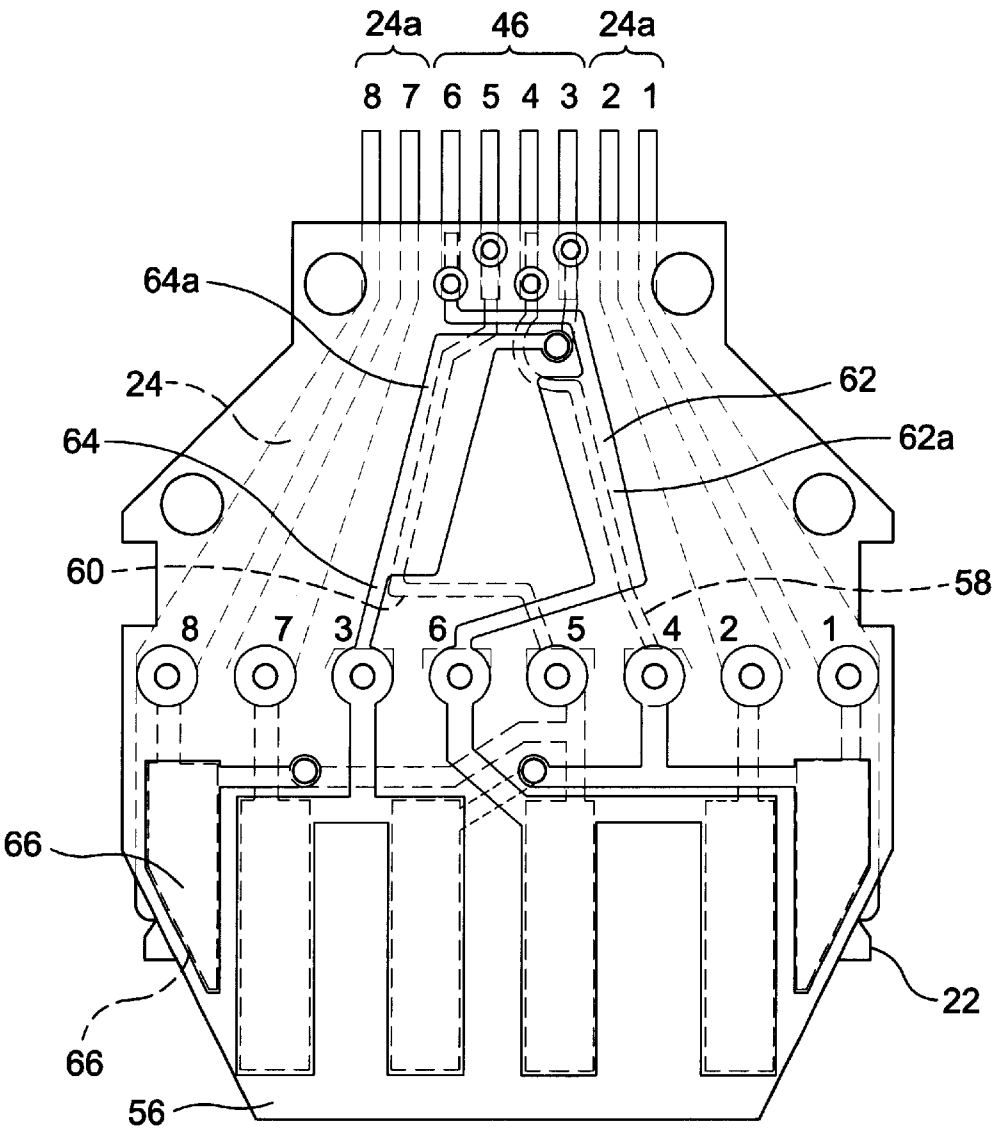
FIG. 15 is a bottom view of an alternative embodiment of the present invention showing a circuit board attached to a contact holder and contacts.

Referring now to FIG. 15, a further alternative embodiment is shown having conductive paths formed on a PCB which carry the signals between the IDC's and the forward contact for four of the eight signal paths. Specifically, PCB 56 includes conductive paths 58 and 60 which carry the signal for signal lines 4 and 5. Conductive paths 58 and 60 are formed on the top side of the PCB and extend to the forward portion of the board where they are each in electrical communication with corresponding forward contacts 46. The forward terminal portions 24*a* of contacts 24 and forward portions 46 of its conductive traces are shown extending forwardly in FIG. 15. During a subsequent manufacturing step, portions 46 and 24*a* would be bent upwardly as shown in FIG. 9. The signal paths 6 and 3 are carried by conductive paths 62 and 64 on the bottom side of the board and extend forwardly to the forward contacts. Paths 62 and 64 have a central region, 62*a* and 64*a* respectively, which has a significant width. Central regions 62*a* and 64*a* are each aligned with and coextensive with one of the traces 58 and 60 formed on the top side of the board creating a capacitive and inductive coupling between the various signal paths. Specifically, signal paths 3 and 5 are capacitively/inductively coupled together and signals 4 and 6 are also similarly coupled.

In addition, as in the previously described embodiments, capacitive coupling between the various signal lines is created behind the IDC's through use of overlying conductive traces forming tabs 66 separated by the dielectric substrate forming PCB 56. While the size of the tabs and the particular coupling of the signal paths differs, the principal of achieving crosstalk reduction by controlling the capacitive/inductive coupling between signal paths is the same.

Figure 16:
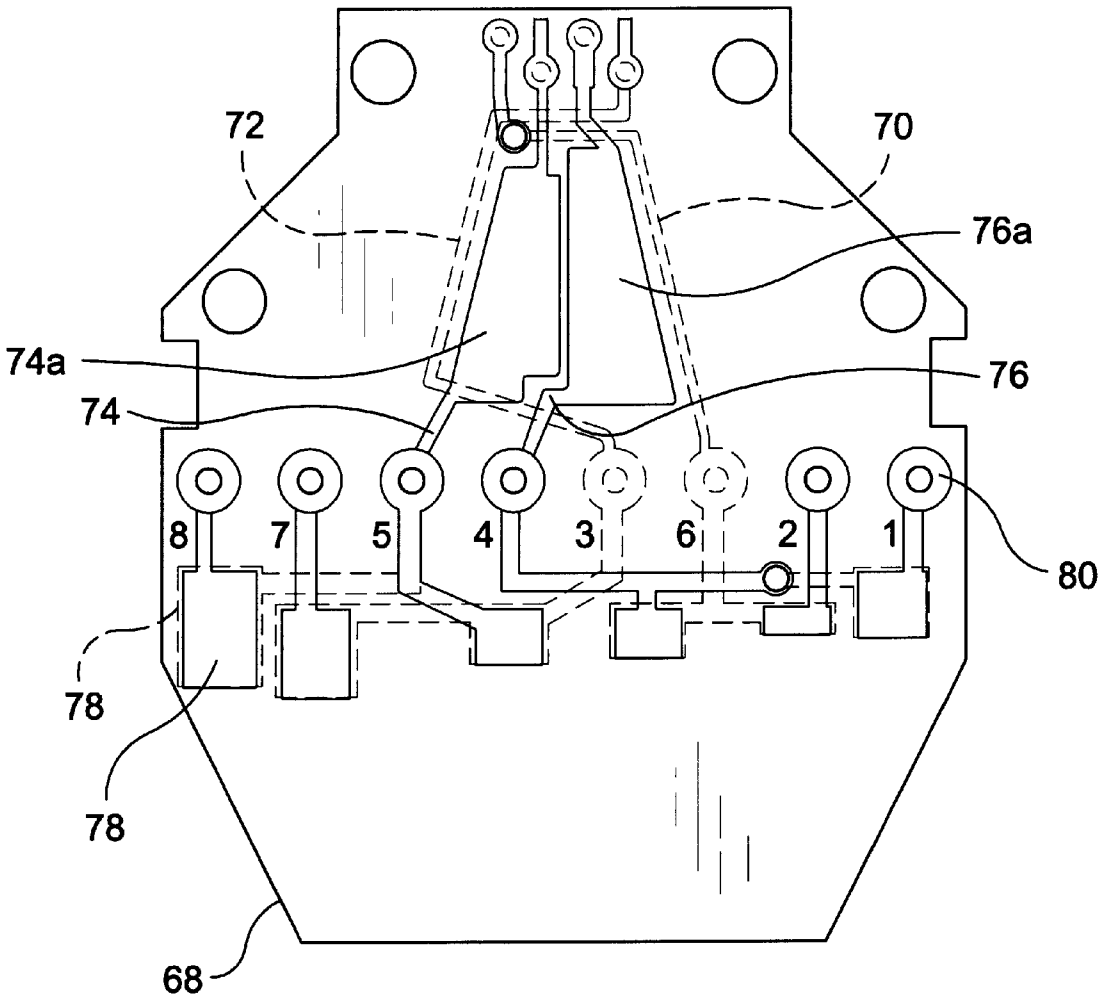
FIG. 16 is a bottom view of another alternative embodiment of the present invention showing an alternative circuit board layout

Referring to FIG. 16, an alternative PCB 68 embodiment is shown. Signal carrying conductive paths 70 and 72 form signal paths 6 and 3 respectively. Conductive paths 70 and 72 are preferably formed on the top surface of PCB 68 and are essentially thin linear elements. Two additional conductive paths 74 and 76 are formed on the bottom surface of the PCB and form signal paths 5 and 4 respectively. Conductive paths 74 and 76 have an enlarged intermediate portion 74*a* and 76*a*, respectively, formed in the central region of the circuit board as shown in FIG. 16. Conductive paths do not overlie each other as in the previously described embodiments. However, due to the proximity of the traces on the board capacitive and inductive coupling will occur to a degree which will assist in reducing crosstalk.

Printed circuit board 68 also includes a plurality of conductive traces forming tabs 78 formed behind the line of IDC's. Tabs 78 are each electrically connected to a corresponding contact by weld points 80 formed on the PCB as in the preferred embodiments. These tabs are formed on both sides of the circuit board and therefore form capacitive plates which capacitively couple the various signal paths. For example as shown in FIG. 16, signal 1 is coupled to signal 4, and signal 2 is coupled to signals signals 4 and 6.

In this embodiment, capacitance is also introduced between signal paths by way of the routing of conductive paths 70, 72, 74 and 76. It has been found, that by changing the shapes of the conductive paths, the capacitance and inductance between the various signal paths can be altered thereby leading to a reduction in crosstalk. Therefore, conductive traces 74 and 76 have an enlarged portion 74*a* and 76*a* respectively. The enlarged portions permit capacitive coupling between the edges of the of the adjacent traces while permitting the centerline of the inductance path to be located away from the edge.

As in the preferred embodiments, the jack PCB shown in FIG. 15 permits the paired signal wires 16 to remain together up until securement to the IDC's. Conductive traces 70, 72, 74 and 76 are routed such that the forward contacts carry the signals in a sequential manner for compatibility purposes.

Figure 17:
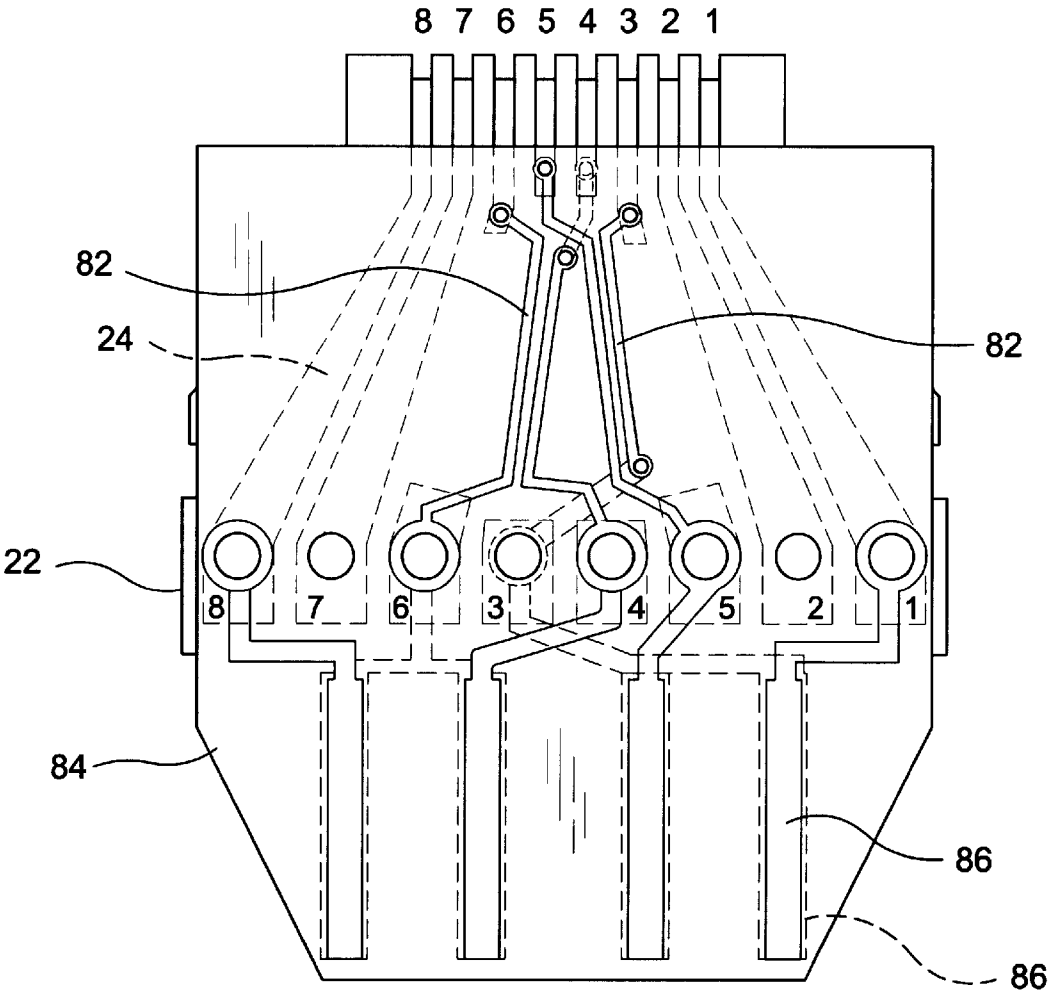
FIG. 17 is a bottom view of still another alternative embodiment of the present invention showing a circuit board attached to a contact holder and contacts.
Figure 18:
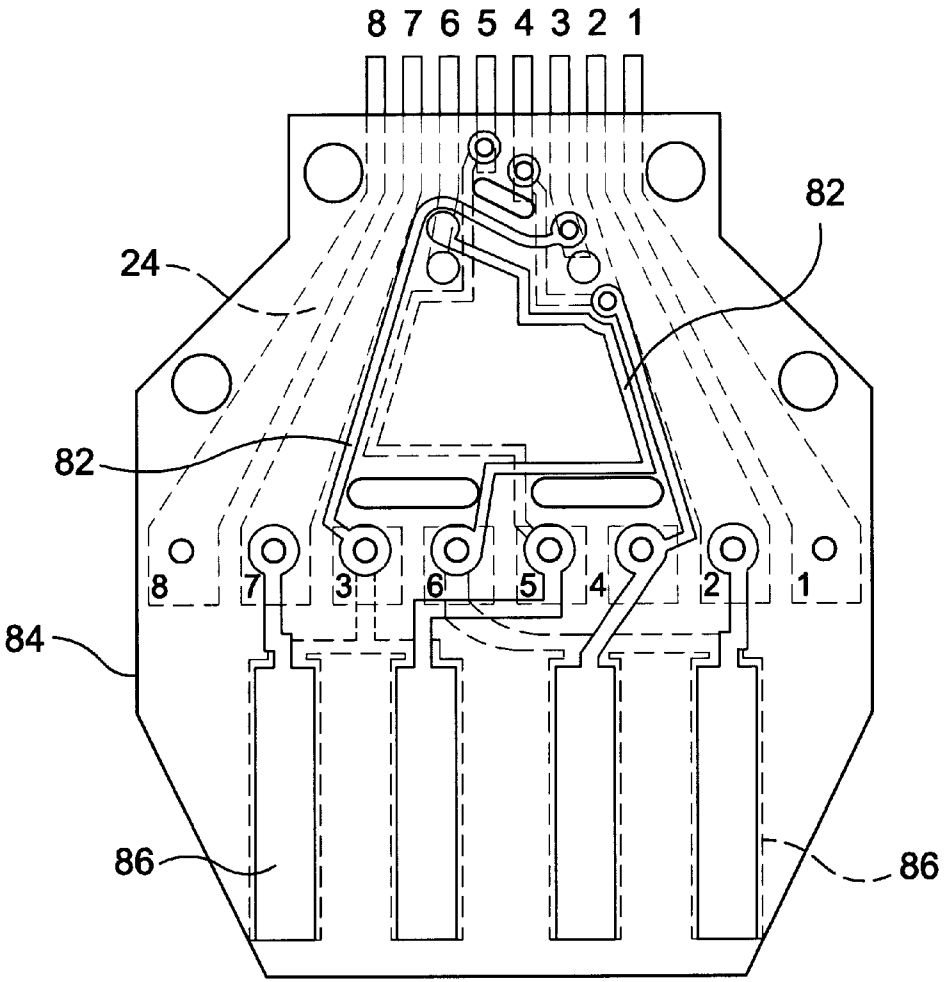
FIG. 18 is a bottom plan view of yet a further alternative embodiment of the present invention showing a circuit board attached to a contact holder and contacts.

Further alternative embodiments of the present invention are shown in FIGS. 17 and 18. These embodiments depict other manners in which conductive paths 82 can be formed and routed on a PCB 84 in order to reduce crosstalk in the jack. Conductive tabs 86 are also employed to provide capacitive coupling between the signal paths.

In a further alternative embodiment (not shown), all signal carrying elements may be formed of paths on the PC board in which case no contacts would be used.

Figure 19:
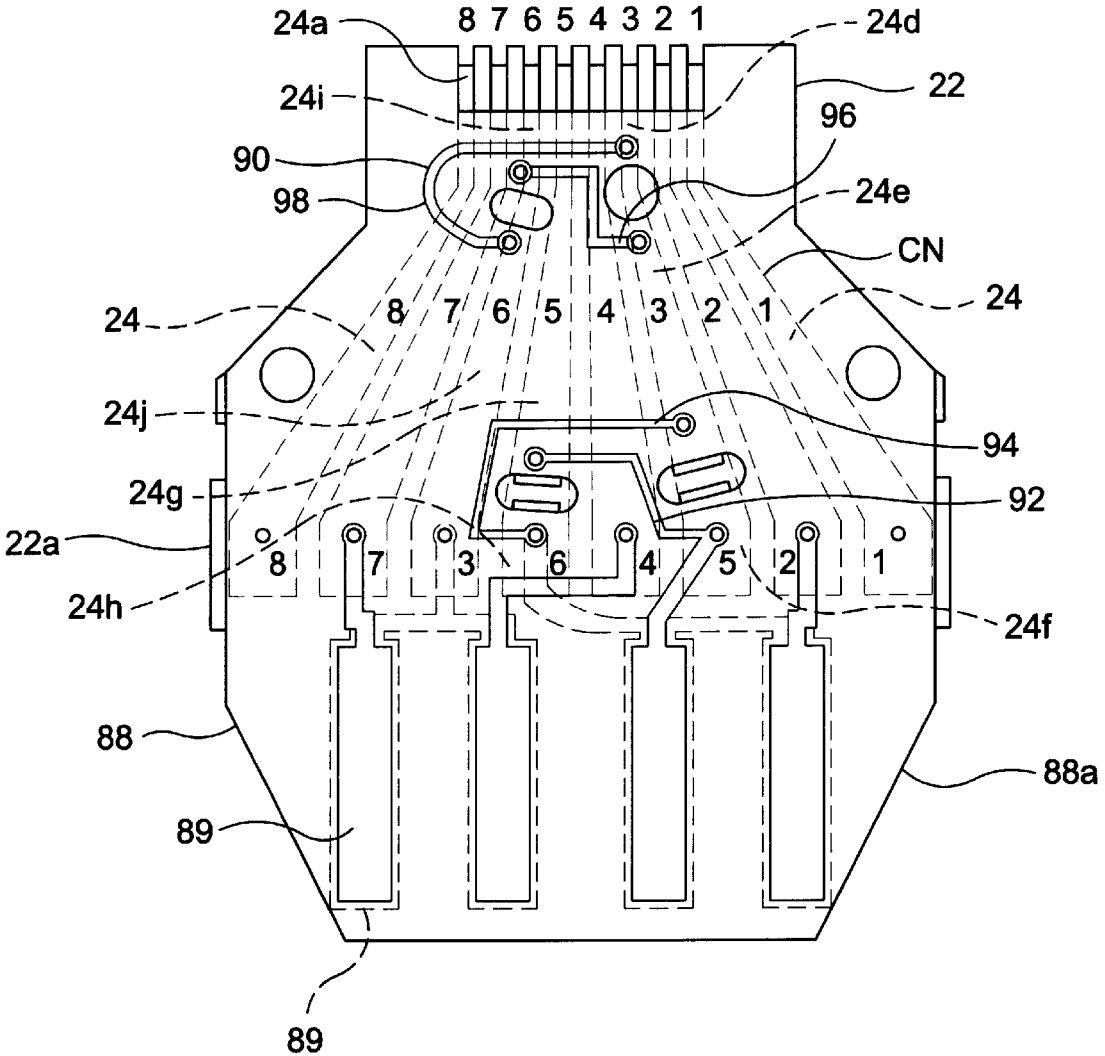
FIG. 19 is a bottom view of an alternative embodiment of the present invention a printed circuit board attached to a contact housing in which all the signal paths are formed by contacts.

With reference to FIG. 19, the present invention further contemplates a jack 10 having a PCB 88 in which all of the signal carrying elements are formed by contacts 24. PCB 88 provides for capacitive coupling to occur on the rearward portion 88*a* of PCB behind the IDC's using traces and tabs 89 in a manner similar to the previously described embodiments. The forward portion of the PCB also supports conductive traces 90 which reroute the signals between selected contacts to achieve crosstalk reduction and permit the signal pairs to remain together upon termination in the jack. The signal path of three of contacts 24 are rerouted in order to control the distance over which the signal paths run in order to achieve the proper inductive coupling to reduce crosstalk. Thus, at a rear portion 22*a* of contact housing 22, signal path 5 is placed between contacts carrying signals 4 and 3 and signal path 6 is placed between contacts carrying signal paths 2 and 4. Toward the forward portion of contact housing 22 signal path 3 is placed between contacts carrying signals 2 and 4 and signal path 6 is placed between contacts carrying signal paths 5 and 6. Therefore, it can be seen that the forward terminal portions 24*a* of the contacts remain in the proper sequential order of signal paths 1–8 and therefore compatibility is maintained. It is also within the contemplation of the present invention that the signal paths of each signal pair could be reversed, e.g., 1-2, 2-1, and still be compatible with other connectors due to the differential nature of the signal pairs. This would apply for the previously described embodiments as well.

In preferred way to accomplish the signal path rerouting, contacts 3, 5 and 6 are severed with contact 3 being severed in two places. In FIG. 19, the actual contacts are numbered by their location in contact housing 22 and not necessarily the signal carried thereon. Numbers identifying the actual signal are shown at both ends of the contact 24. Contact 3 includes a forward portion 24*d*, a discontinuous middle portion 24*e* and a discontinuous rearward portion 24*f*. Contact 5 includes a forward portion 24*g* and a discontinuous rearward portion 24*h*. Contact 6 includes a forward portion 24*i* and a discontinuous rearward portion 24*j*. It is also within the contemplation of the present invention that the rerouting could be achieved without severing but by crossing over the contacts as is known in the art and disclosed in U.S. Pat. No. 5,362,257, the disclosure of which is incorporated by reference herein.

The rerouting of the signal paths is achieved by way of conductive traces 90 formed on PCB 88. A first conductive trace 92 electrically connects the rearward portion of contact 3, 24*f*, to a forward portion of contact 5,24*g*. A second conductive trace 94 electrically connects a rearward portion of contact 5, 24*h*, to the intermediate portion of contact 3, 24*e*. A third conductive trace 96 electrically connects intermediate portion of contact 3, 24*e*, to the forward portion of contact 6, 24*i*. A forth conductive trace 98 electrically connects the forward portion of contact 3, 24*d*, to the forward portion of contact 6, 24*j*.

In addition, PCB 88 preferably includes an insulating layer formed over the top surface thereof in order to insulate the board top traces from inadvertent engagement with contacts 24. Additionally, a further insulating layer may be applied to the bottom of PCB 88 in order to protect and insulate board bottom traces.

A two-sided board is depicted in order to accommodate capacitive tabs, as described below. However, the rerouting of signal paths could be achieved by way of a one-sided board.

Figure 20:
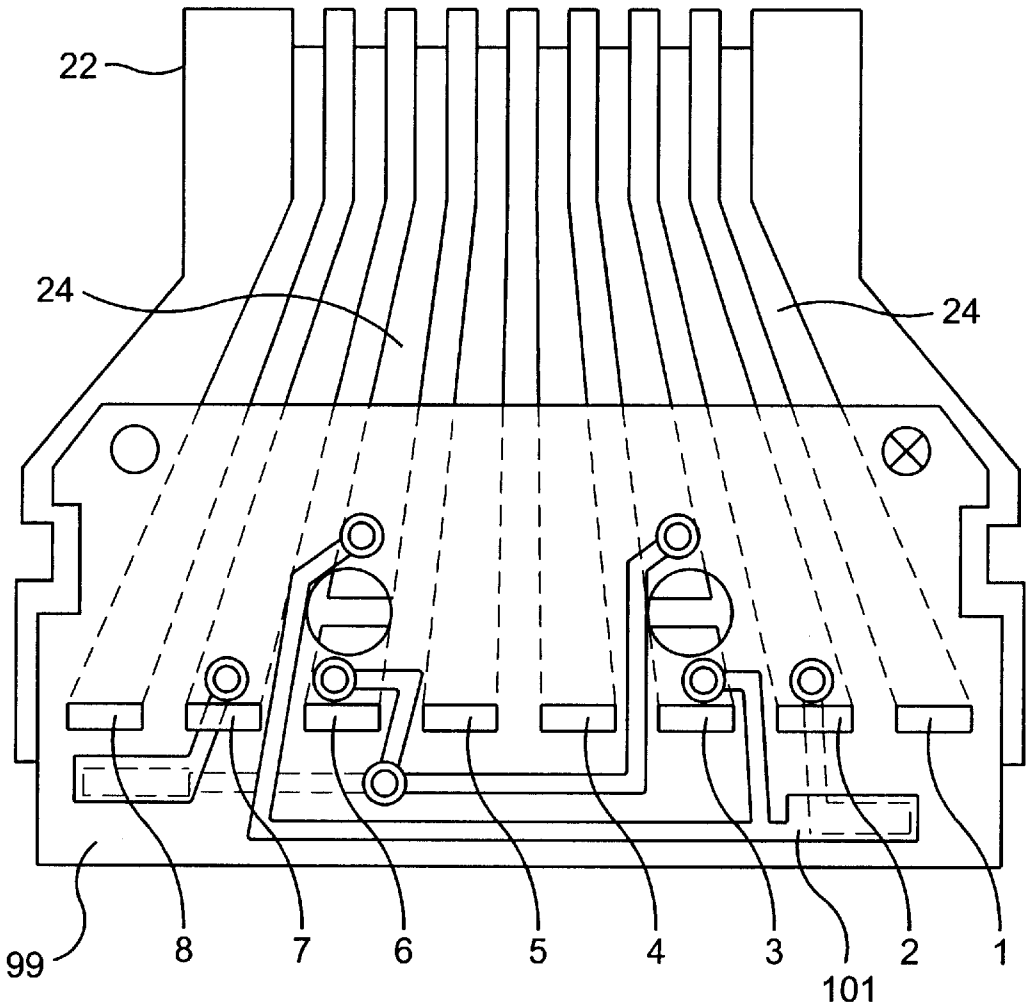
FIG. 20 is a bottom view another alternative embodiment of the present invention a printed circuit board attached to a contact housing in which all the signal paths are formed by contacts.

While a preferred routing of signal paths is set forth above, it is within the contemplation of the present invention that other rerouting paths could be employed to achieve the desired coupling between signal paths in order to reduce crosstalk. For example, FIG. 20 depicts still a further embodiment which includes severed contacts and rerouting of signal between various contacts. In addition, capacitive coupling between various contacts is achieved by capacitive tabs 101 formed behind the IDC's on PCB 99.

In a further alternative embodiment, capacitive coupling between contact pairs may be the sole manner in which crosstalk reduction is achieved. Accordingly, the severing of the contacts and rerouting of the traces would not be required. In this embodiment various traces which are electrically connected to individual contacts may be placed in spaced proximity to achieve capacitive coupling between contacts. The traces may be formed on the portion of the circuit board which extends rearwardly of the IDC's as in the preferred embodiment.

Figure 21:
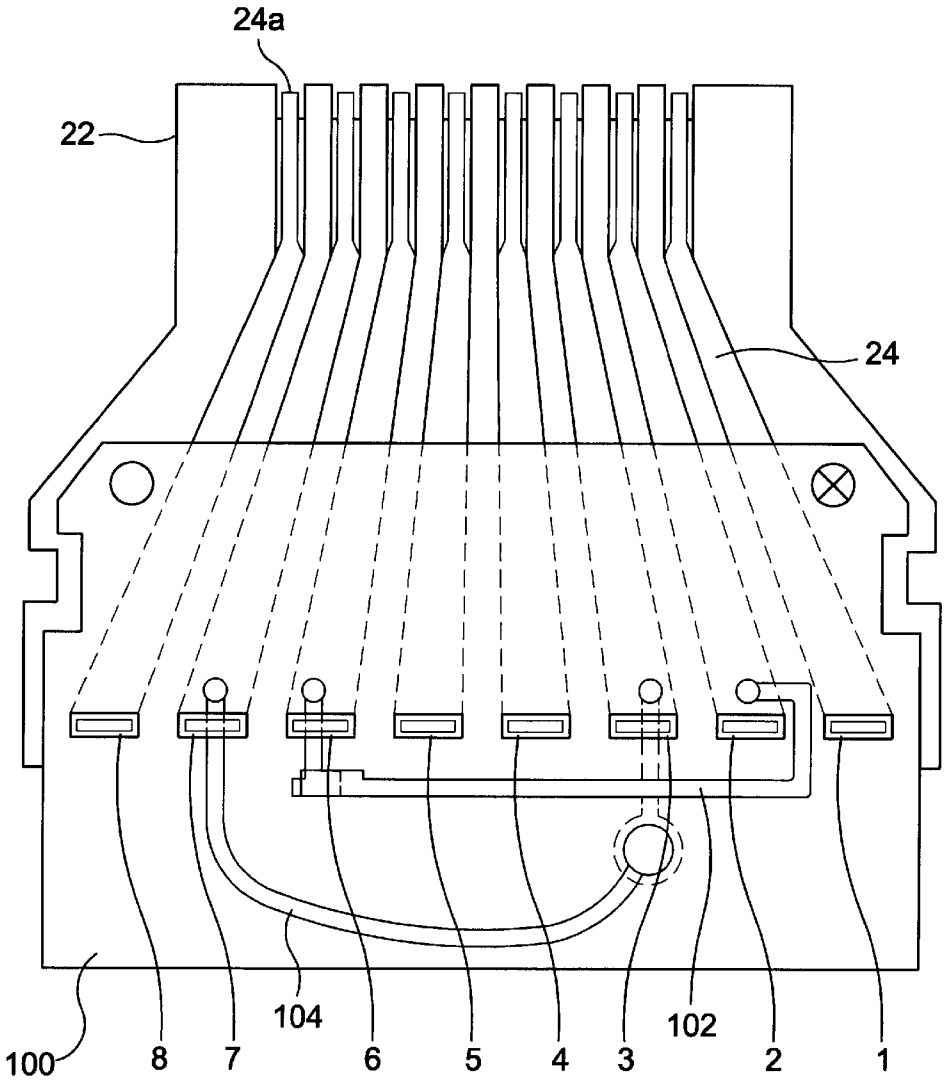
FIG. 21 is a bottom view of a further alternative embodiment of the present invention a printed circuit board attached to a contact housing in which all the signal paths are formed by contacts.

Specifically, as shown in FIG. 21, all eight contacts, 1–8, extend across jack 10 in an uninterrupted manner as in a standard RJ45 jack. A PCB 100 includes conductive traces 102 and 104 which permits contact 2 to be capacitively coupled to contact 6, and contact 3 to be capacitively coupled to contact 7. In the connector of the present invention, the signal carried on contact 2 tends to be induced onto contact 3 due to the parasitic capacitive coupling between contacts 2 and 3. The resultant crosstalk can be compensated for by capacitively coupling contacts 2 and 6. Therefore, any signal induced on contact 3 is also induced on contact 6, and since contacts 3 and 6 form a signal pair, the induced signals will be canceled out. Similarly, the negative crosstalk effects resulting from a parasitic coupling between contacts 7 and 6 can be compensated for by capacitively coupling contacts 7 and 3 by way of conductive traces. Contact pair 3, 6 is unique since these contacts are separated on the connector by contacts 4 and 5. Therefore, it is especially important to insure that parasitic signals are induced equally on contacts 3 and 6 since contacts 3 and 6 are non-adjacent and therefore capacitively isolated.

Furthermore, it may be desirable to ensure that the conductive traces do not run parallel and adjacent with each other in order to avoid the introduction of crosstalk between the conductive traces. The present invention as shown in FIG. 21, permits the PCB to be sized to accommodate the routing of traces 102 and 104 which avoids parallel routing paths and the unwanted introduction of crosstalk associated therewith.

It is also within the contemplation of the present invention that the traces, especially the portions which overlie each other forming capacitive coupling, can take a variety of shapes including rectangular, circular, etc. in order to obtain the desired capacitance.

It is understood that the connector jacks including the various embodiments described above, may be used in conjunction with the plug of the present invention described below with respect to FIGS. 22–28 in which certain wires are routed in the plug such that they cross. It is also to be understood, that these jacks could also be used with a standard plug with conventional wiring in which the signal wires remain substantially parallel to each other throughout the plug.

Figure 22:
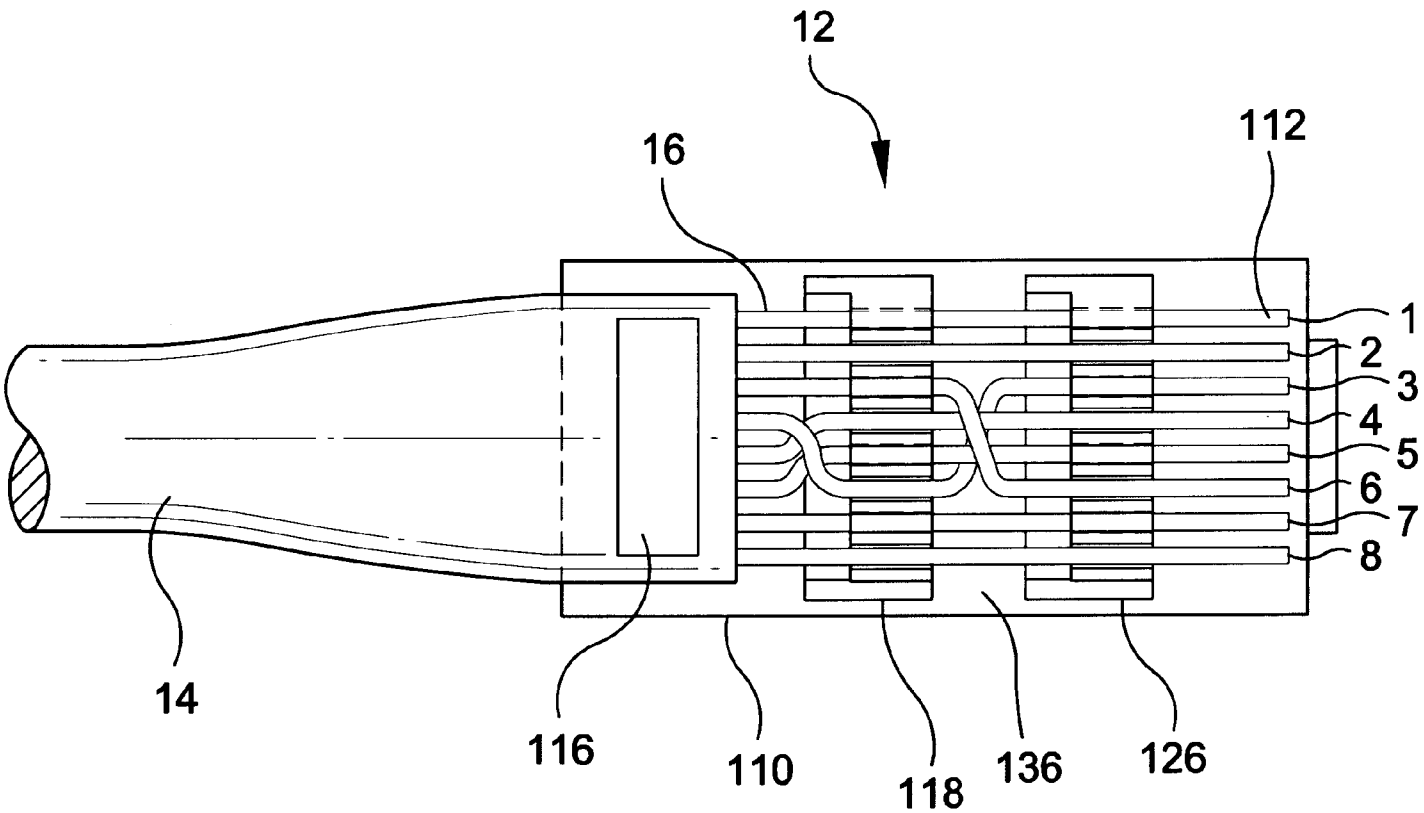
FIG. 22 is a top plan view of a first preferred embodiment of a plug connector of the present invention showing the signal wire secured in the plug.

The present invention also includes a plug connector which permits high speed data transmissions while controlling signal degrading crosstalk interference to acceptable levels. The plug 12 portion of the connector assembly is preferably an RJ45 compatible plug which mates with jack 10 in a manner which is well known in the art. With reference to FIG. 3 and 22, plug 12 generally includes a dielectric body 110 having a forward end in which plug contacts in the form of conductive plates 112 are secured. Plug body 110 defines a cavity 136 adapted to receive signal wires 16. The signal wires terminate in the plug and electrically communicate with conductive plates 112 which engage the cantilevered contacts portion 24*a* and conductive traces forward contacts 46 in a manner well known in the art. A strain relief 116 is also provided which bears against cable 14 as in a typical RJ45 plug connector.

Plug 12 is configured to be selectively insertable within jack 10. Upon insertion of plug 12 into jack 10, an upper portion of conductive plates 112 engage the cantilevered forward contact 24*a* and 46 such that they deflect in a manner well known in the art. Accordingly, a positive connection is made between the signal paths in the connector and the plug.

FIGS. 22–26 show a first preferred embodiment of a plug 12 which reduces crosstalk between signal pairs. Crosstalk reduction is achieved by maintaining the signal pairs together for as much distance as possible and by routing the signal wires as they extend across the plug such that inductances are matched. The theory behind such a design is set forth above with reference to the plug described in FIGS. 4 and 5. Essentially, by twisting the signal pairs together, crosstalk between the particular signal pairs is essentially eliminated since any signal induced by one wire of a pair will also be induced on the other wire of that pair due to their proximity. Since the signal wires carry differential signals, as long as an equal signal is induced on both wires of a particular pair, no detrimental effect will result from a stray signal. However, in conventional connectors, in order to insert the signal wires in the plug and maintain a sequential output arrangement 1–8, the twisted pairs must be untwisted and spaced parallel to each other. In doing so, signal wires 3 and 6 which form a signal pair, are separated by wires 4 and 5. Accordingly, a signal may be induced on wire 3 which is not induced on wire 6 or vice versa. This would lead to unwanted crosstalk interference.

In order to reduce detrimental crosstalk in the plug and improve overall performance of the plug and jack combination, the present invention provides for crossing signal wires 3 and 6 as they extend across plug 12. Therefore, if signal wire 6 extends a certain distance between signal wires 2 and 4, the signal wire 6 may pick up a stray signal from those adjacent signal wires. The same would be true for signal wire 3 which may extend between signal wires 5 and 7. By switching the position of signal wires 3 and 6 in the plug, wire 3 will now extend between signal wires 5 and 7, and therefore, will be subject to any stray signals that wire 6 was subject to and wire 6 will be exposed to the same signals that wire 3 was exposed to. Therefore, each wire of the signal pair will have been exposed to the same extraneous signals resulting in those extraneous signals being essentially canceled out. In this embodiment, signal wires 3 and 6 are crossed in the plug. By crossing over signal wires 3 and 6, the present invention is able to reduce crosstalk and still provide output contacts which carry the signals in a sequentially arranged manner.

Figure 23A:
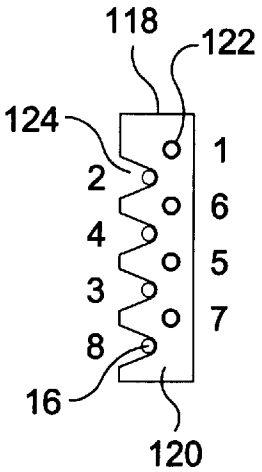
FIG. 23A is a front elevational view of the wire management bar of FIG. 23.
Figure 23:
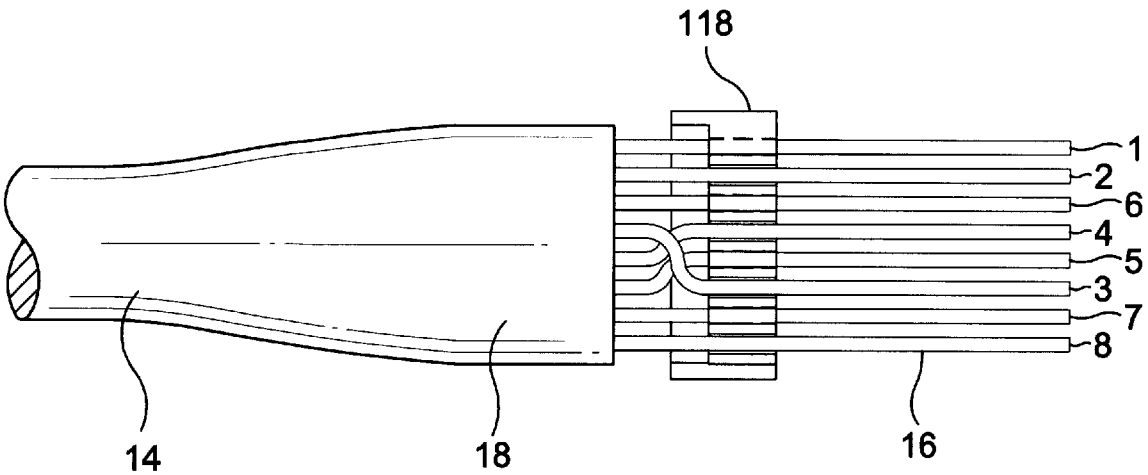
FIG. 23 is a top plan view of a wire management bar inserted on the signal wires.

The manner in which the signal wires are crossed within the plug in accordance with the preferred embodiments is shown in FIGS. 22–26. First, the individual signal wires 16, which carry signals 1–8, extending from the wire cable insulation 18 are untwisted. Signal wires 16 are preferably left in the twisted state within the cable insulation 18. Then, signal wire 3, i.e., the signal wire carrying signal 3, of signal pair 3 is extended transversely such that it crosses over signal wires 4 and 5 of signal pair 2 at a point adjacent to the insulation of the cable as shown in FIG. 23. The distance from the front end of the cable insulation to where signal wire 3 crosses over wires 4 and 5 is preferably 4 mm or less.

As shown in FIGS. 23 and 23A, signal wires 16 are then inserted into a first wire management bar 118. First wire management bar 118 preferably includes a plastic body 120 having a plurality of through holes 122 and slots 124 to receive the signal wires and retain signal wires 16 in a certain position. First wire management bar 118 is moved back and forth along signal wires 16 to straighten the signal wires and to ensure free movement between first wire management bar 118 and signal wires 16. First wire management bar 118 is preferably positioned near the base of cable insulation 18, just above the crossing of signal wire 3.

Figure 24:
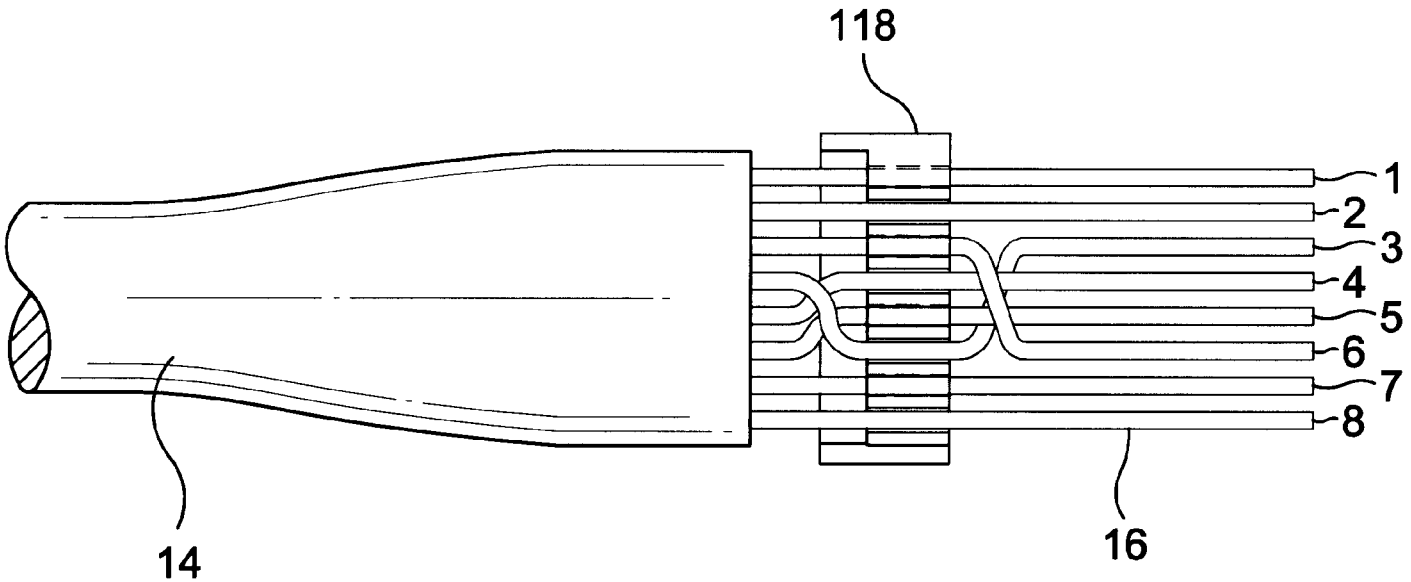
FIG. 24 is a top plan view of the wire management bar inserted on the signal wires of FIG. 23 further showing the rerouting of the signal wires.
Figure 25:
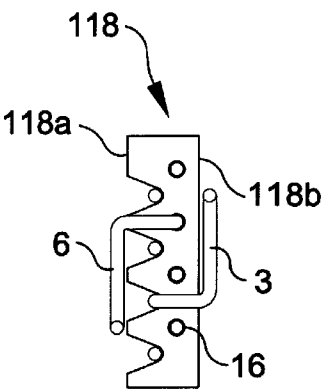
FIG. 25 is a front elevational view of the wire management bar of FIG. 24 showing signal wires crossing.

Referring to FIG. 24 and 25, signal wire 6 is then bent toward the front side 118*a* of the wire bar 118. Signal wire 3 is then bent toward the back side 118*b* of the wire bar 118. Signal wire 6 is further bent to extend transversely around wires 4 and 5. Likewise signal wire 3 is bent to extend transversely such that it extends back across signal wires 4 and 5 (FIG. 25). It also crossed signal wire 6 at this point. Signal wire 6 is then positioned longitudinally with the other wire pairs so that it rests in signal wire 3's previous position. This procedure is repeated for signal wire 3 until it rests in signal wire 6's previous position. This completes the crossing of signal wires 3 and 6.

Figure 26:
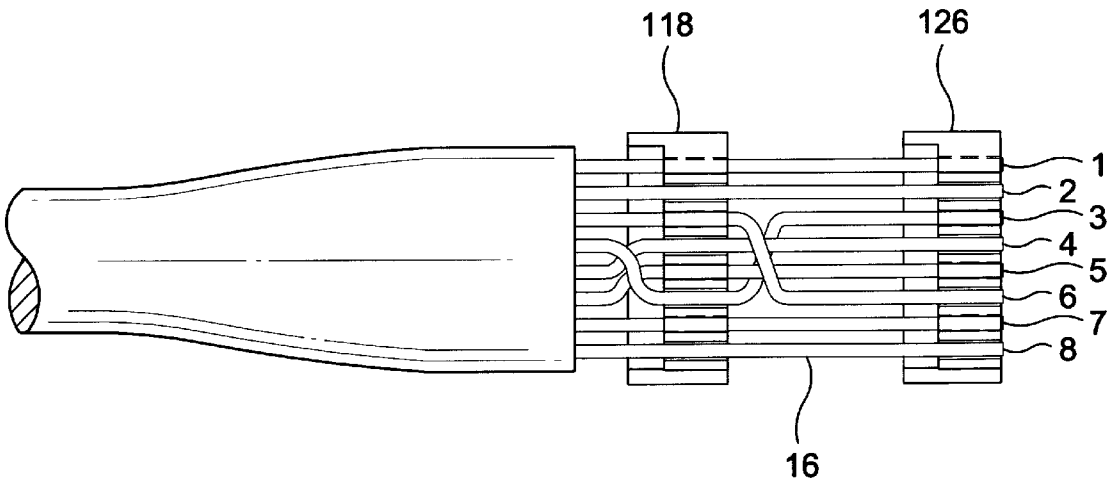
FIG. 26 is a top plan view showing a first and second wire management bar positioned on the signal wires.

Referring to FIG. 26, a second wire management bar 126 is employed to further retain signal wires 16. Second wire management bar 126 is formed similarly to first wire management bar 118. Second wire management bar 126 is slid over the wires until it presses firmly against first wire management bar 118. This will ensure a tight crossing of signal wires 3 and 6. In the preferred embodiment, the second wire management bar 126 is then positioned approximately 14.75 mm (0.58 in) from the end of cable insulation 18, and the signal wires may then be trimmed to the proper length for insertion in plug body 110.

The prepared wiring assembly including the first and second wire management bars may then be inserted into the plug body 110 until the signal wires are "bottomed-out" at the front of plug 12 as shown in FIG. 22. The wires will slide through the second wire management bar 126 as they enter individual wire guides (not shown) at the front of plug body 110. In this position, signal wires 16 are aligned with the bottom portion of conductive plates 112. As is known in the art, plates 112 preferably include an insulation piercing formed at the bottom thereof such that when plates 112 are pressed downwardly, electrical connection will occur between the signal wires and their corresponding plate 112.

When signal wires 16 have been properly inserted in plug body 110, the individual wires are sequentially arranged 1–8 and the plug is able to be inserted into a standard jack or a jack formed in accordance with the present invention.

In the preferred embodiment, plug 12 wired in the manner as set forth above, if mated to jack 10 having the configuration as shown in FIGS. 10–12, crosstalk reduction is achieved to such a level that the jack and plug combination meets the requirements under the Category 6 link and channel test protocol.

Test data showing the near end crosstalk, NEXT performance of the combination of the jack of the first and second preferred embodiments and the first preferred embodiment of the plug under the connecting hardware test protocol at 100 MHZ are as follows:

| Signal pairs | NEXT Loss (dB) 1st Pref. Embod. | NEXT Loss (dB) 2nd Pref. Embod. |
|---|---|---|
| 2 and 3 | 54.65 | 51.11 |
| 1 and 3 | 54.53 | 51.28 |
| 3 and 4 | 52.919 | 56.87 |
| 1 and 2 | 63.12 | 57.75 |
| 2 and 4 | 50.8 | 51.13 |
| 1 and 4 | 60.935 | 59.85 |

Figure 27:
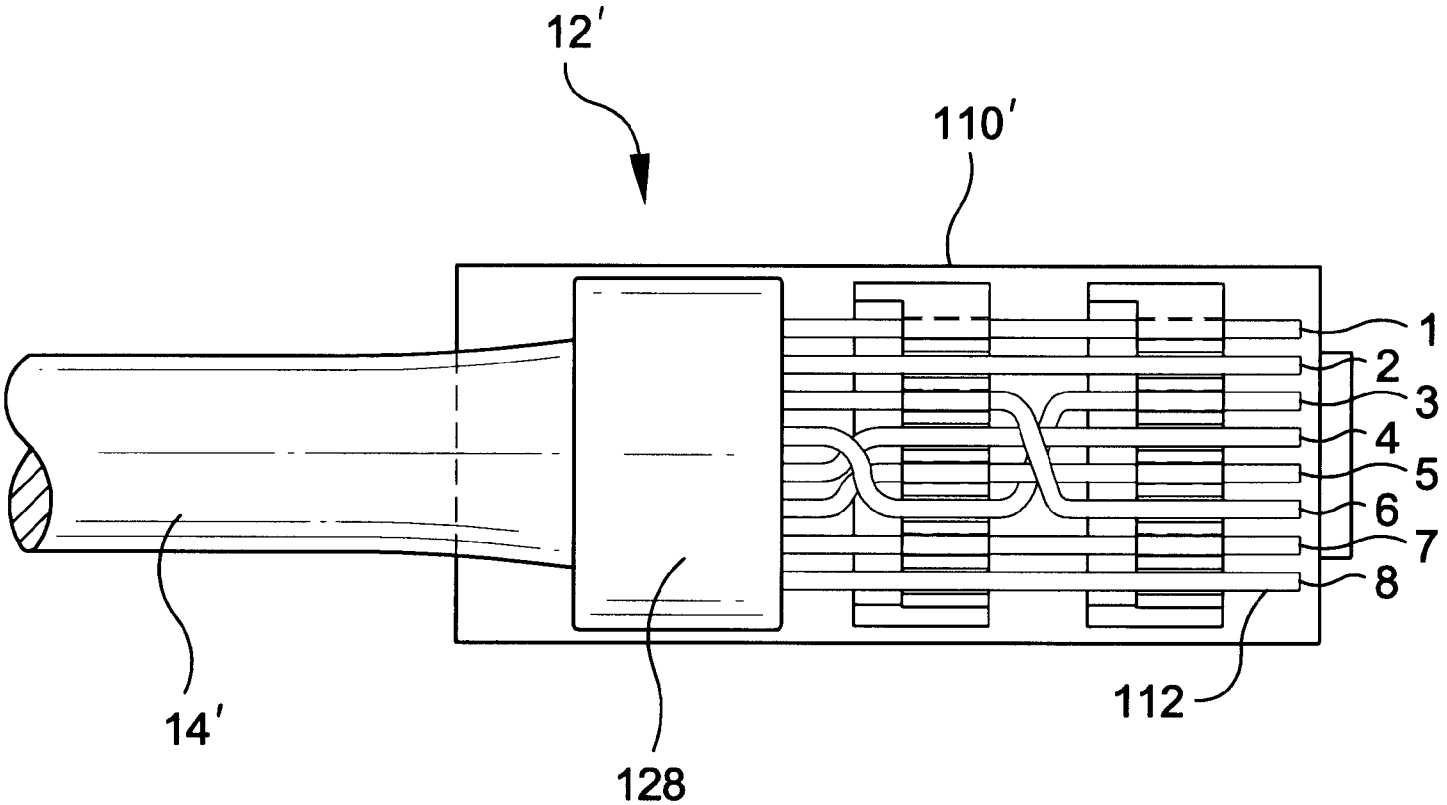
FIG. 27 is a top plan view of a second preferred embodiment of a plug of the present invention showing shielded signal wire secured in the plug.
Figure 28:
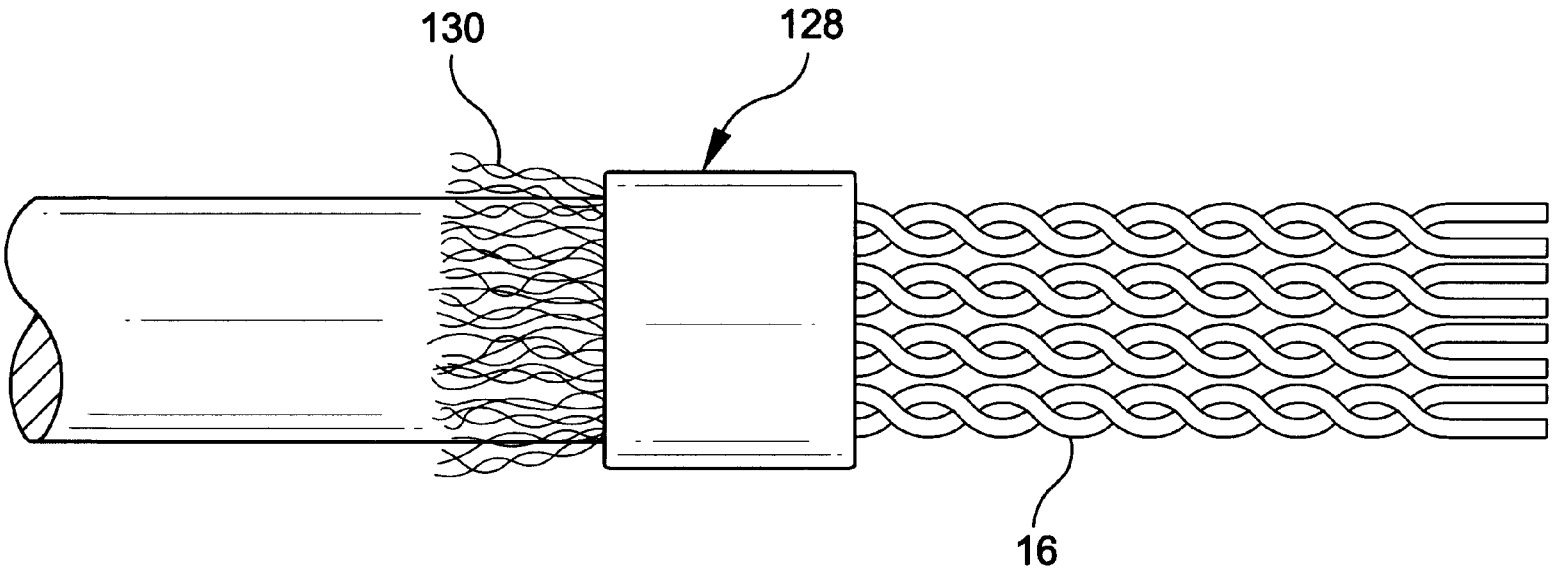
FIG. 28 is a top elevational view of the shielded cable showing the twisted signal wire pairs used with the second preferred embodiment shown in FIG. 27.
Figure 29:
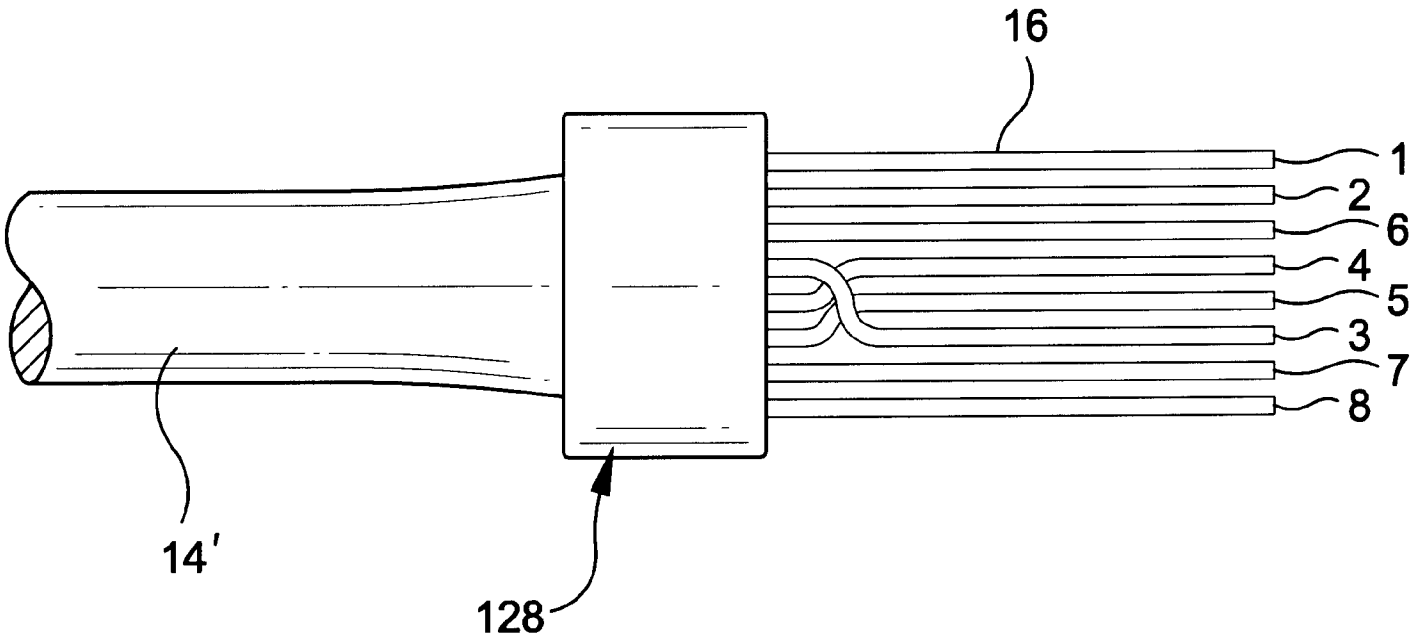
FIG. 29 is the cable of FIG. 26 showing a ferrule positioned in place and a first signal wire crossing.

In the alternative preferred embodiment, shown in FIGS. 27–29, a plug connector 12', which permits crossing over of the wires therein, is provided for use with a shielded cable 14'. Shielding may be desirable if the wiring runs adjacent to "noise" producing electronic components or other wires that admit an EMF which could distort the signal carried by the signal wires. The crossing over of signal wires 3 and 6 is as described above. The only additional steps in assembling the cable to the plug body 110' include the use of a conductive ferrule 128 which is crimped over wire braid 130 which has been pulled back over the cable, as shown in FIG. 28. In this embodiment the second wire management bar 126 is pushed onto the wires and positioned approximately 21.5 mm (0.85 in.) from the bottom of the ferrule 128. Plug 12' also includes an outer metallic housing of the type known in the art (not shown) forming a shield which is in electrical contact with ferrule 128.

The plug body 110' which is used with the shielded cable is substantially similar to the plug body used with unshielded. However, the back end of the body is adapted to receive the crimped ferrule 128 as shown in FIG. 27. In addition, the metal shielding (not shown) which wraps around the plug includes a depending spring contact which engages ferrule 128 upon insertion of the wire into the plug. Accordingly, the shield of the plug is in electrical communication with the shielding of the wiring.

Alternative plug wiring arrangements are contemplated by the present invention in order to reduce crosstalk. For example with regard to plug 12, the wires may be inserted therein in the following order: 2, 1, 3, 6, 5, 4, 8, and 7, as shown schematically in FIG. 4. Accordingly, the signal pairing is maintained. However, in order to maintain compatibility of the plug for use with standard jacks, it is important that the output of the plug, i.e., the conductive plates 112, presents signal paths corresponding to a sequential configuration 1–8. To achieve this, signal wires 16 within plug body are rerouted as they extend across the plug. With reference to FIG. 4, in an alternative embodiment, signal wires 1 and 2 are crossed and wire 6 crosses wires 4 and 5. Signal wires 4 and 5 cross within the plug as do wires 8 and 7. Accordingly, the signals present at the plug output go from 1 to 8 sequentially. It is also within the contemplation of the present invention that the signal paths of each signal pair could be reversed, e.g., 1-2, 2-1, and still be compatible with other connectors due to the differential nature of the signal pairs.

Figure 30:
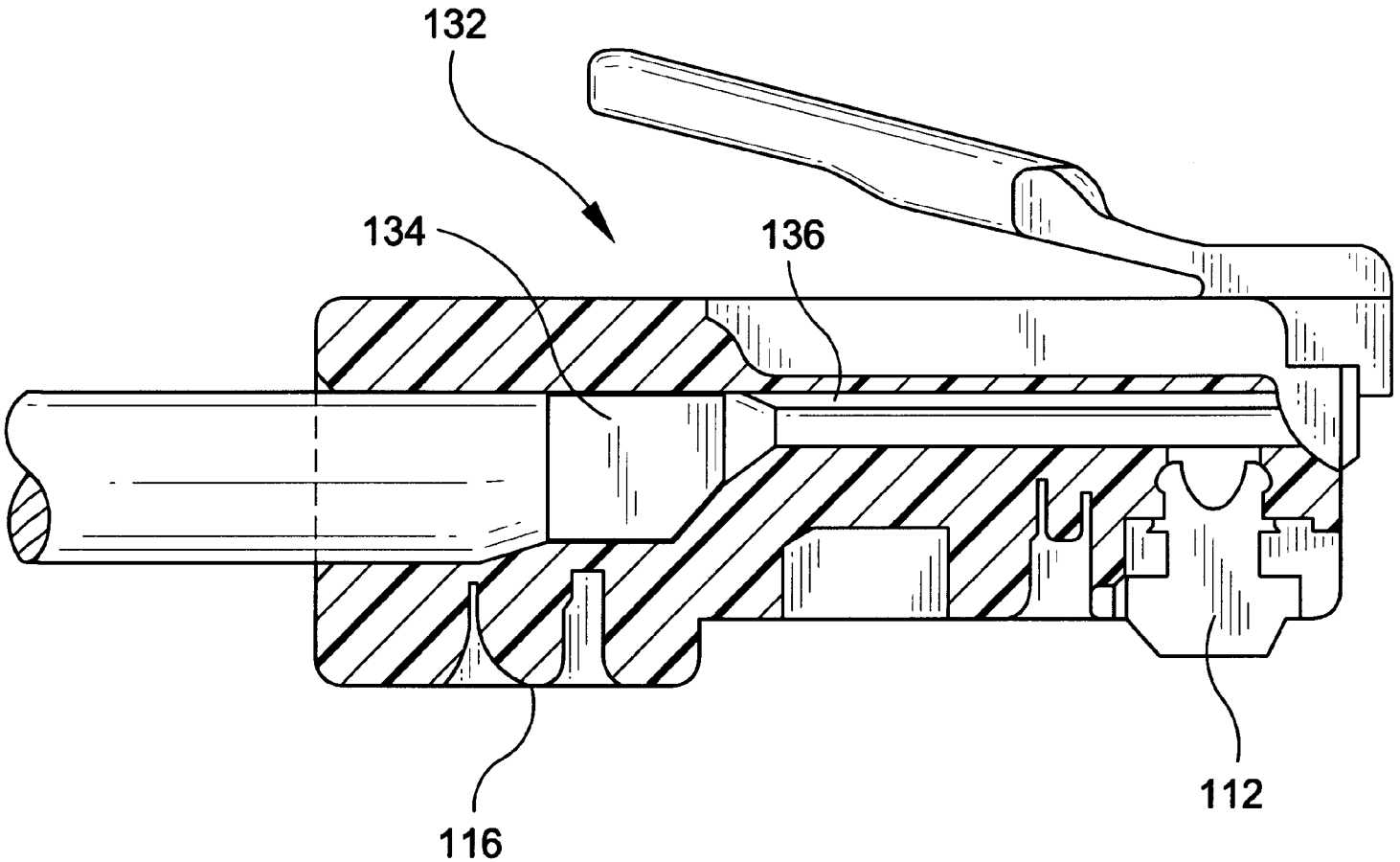
FIG. 30 is a cross sectional view of an alternative embodiment of a plug connector of the present invention.
Figure 31:
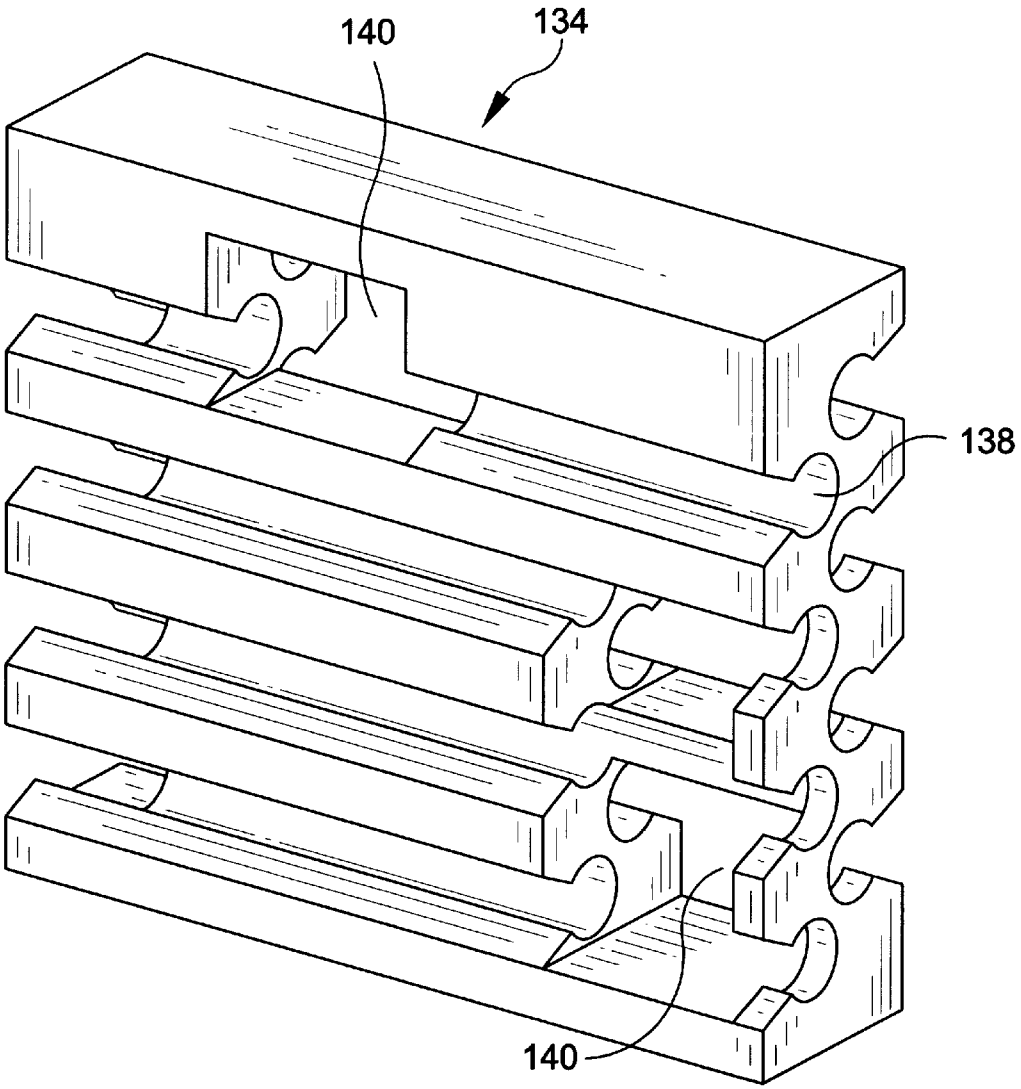
FIG. 31 is a perspective view of an alternative embodiment of a wire management bar used with the plug of FIG. 30.

With reference to FIGS. 30 and 31, in order to maintain the wiring in the plug in the proper alignment, plug 132 may further include a wire management bar 134 (FIG. 31) supported within plug cavity 136 as shown in FIG. 30. Wire management bar 134 includes a plurality of wire holding grooves 138 which are configured to capture and retain the individual signal wires 16. A pair of through holes 140 might also be formed in wire management bar 134 to permit signal wires to pass through to an opposite side of the wire management bar 134. Wire management bar 134 also permits an installer to ensure that the wires are crossed over at the precise location in order to achieve maximum crosstalk reduction, the importance of which will be discussed below. It is within the contemplation of the present invention that the wire management bar 134 may be formed in a variety of configurations to accomplish the function of routing the wires in an appropriate manner.

Having described herein the preferred embodiments of the subject invention, it should be appreciated that variations may be made thereof without departing from the contemplated scope of the invention. Accordingly, the preferred embodiments described herein are intended to be illustrative rather than limiting.

What is claimed is:

1. An electrical jack connector comprising:

a plurality of electrically conductive signal carrying elements extending from a first end of the connector to a second end of the connector;

each of said signal carrying elements electrically connected to and extending between an input and output termination device;

a dielectric substrate substantially horizontally aligned with said signal carrying elements, said substrate having a first portion extending between said input and output termination device and being coextensive with said signal carrying elements, and a second substrate portion disposed outside of said first substrate portion and physically remote from said signal carrying elements;

a first conductive trace formed on said substrate and being conductively connected to one of said signal carrying elements, said first conductive trace extending from said one of said signal carrying elements onto said second portion of said substrate; and a second conductive trace formed on said substrate and conductively connected to another of said signal carrying elements, said second conductive trace extending from said another of said signal carrying elements onto said second portion of said substrate, a portion of said first conductive trace and a portion of said second conductive trace being spaced a predetermined distance apart by said substrate at a position on said second portion of said substrate to form a mutual capacitive coupling between said first conductive trace and said second conductive trace physically remote from said signal carrying elements whereby crosstalk is reduced between said signal carrying elements.

2. The connector as defined in claim 1, wherein said substrate has a first and second opposed surfaces and said first conductive trace is formed on said first surface and said second conductive trace is formed on said second surface.

3. The connector as defined in claim 2, wherein said overlying portions of said first and second conductive traces have tab-like configurations.

4. The connector as defined in claim 1, wherein said each of said plurality of signal carrying elements is connected a conductive trace extending therefrom onto said second portion of said substrate, and each of said conductive traces being capacitively coupled to at least one other of said conductive traces at a position on said second substrate portion whereby each of said plurality of signal carrying elements is capacitively coupled to another of said plurality of signal carrying elements to reduce crosstalk between said plurality of signal carrying elements.

5. The connector as defined in claim 1, wherein two of said signal carrying elements extend across said first substrate portion in longitudinally aligned proximity such that capacitive and inductive coupling occurs between said two of said signal carrying elements.

6. The connector as defined in claim 5, wherein said two of said signal carrying elements include conductive paths formed on said substrate.

7. The connector as defined in claim 1, wherein said plurality of signal carrying elements include one elongate conductive contact and one conductive path formed on said substrate.

8. The connector as defined in claim 1, further including a plurality of signal wires forming a plurality of signal pairs and each wire of each signal wire pair is positioned adjacent the other wire of the signal wire pair upon connection to said input termination device such that said signal wires are not sequentially arranged, and said signal carrying elements each include a forward portion forming said output termination which are adapted to be engagable with an element of a plug, and wherein said signal carrying elements are routed across said connector wherein said forward portion of said signal carrying elements carry signals which are sequentially arranged such that the connector is compatible with standardized connection devices.

9. The connector as defined in claim 1, wherein said plurality of signal carrying elements includes a pair of conductive paths formed on said substrate and a pair of discrete contacts.

10. An electrical jack connector comprising:

a connector body;

a plurality of signal carrying elements for carrying electrical signals across the connector between input and output termination devices being positioned in said connector body, said plurality of signal carrying elements including first and second elongate conductive contacts extending from said input and output termination devices;

a dielectric substrate positioned adjacent said first and second contacts;

said plurality of signal carrying elements further including first and second conductive paths formed on said substrate extending between said input and output termination devices; and said first and second conductive paths extending across said connector in mutual longitudinally aligned proximity wherein said first conductive path is capacitively and inductively coupled to said second conductive path whereby crosstalk is reduced.

11. The connector as defined in claim 10, wherein said first and second signal carrying conductive paths are disposed between said first and second contacts.

12. The connector as defined in claim 10, wherein first and second contacts each include an intermediate elongate portion extending between said input and output termination device.

13. The connector as defined in claim 10, wherein said plurality of signal carrying elements includes third and forth conductive paths extending across said connector in mutual longitudinally aligned proximity wherein said third conductive path is captively and inductively coupled to said forth conductive paths such that crosstalk is reduced.

14. The connector as defined in claim 10, wherein said plurality of signal carrying elements includes third and forth conductive contacts and a third and forth elements conductive paths formed on said substrate, said first and second contacts being spaced a distance from third and forth contacts forming a contact free area, said first, second and third and forth conductive paths being disposed within said contact free area.

15. The connector as defined in claim 10, wherein said substrate includes a first portion extending between input and output termination device and a second substrate portion disposed outside of said first substrate portion and away from said signal carrying elements, and a first conductive trace formed on said substrate and being conductively connected to one of said signal carrying elements, said first conductive trace extending from said one of said signal carrying elements onto said second portion of said substrate; and a second conductive trace formed on said substrate and conductively connected to another of said signal carrying elements, said second conductive trace extending from said another of said signal carrying elements onto said second portion of said substrate, a portion of said first conductive trace and a portion of said second conductive trace being spaced a predetermined distance apart by said substrate at a position on said second substrate portion to form a mutual capacitive coupling between said first conductive trace and said second conductive trace whereby crosstalk is reduced between said signal carrying elements.

16. The connector as defined in claim 10, wherein said one of said first and second conductive paths has a width greater then said other of said first and second signal carrying conductive paths.

17. The connector as defined in claim 10 wherein said first conductive path having a width greater than said second conductive path.

18. An electrical plug connector assembly comprising:

a dielectric plug housing having a first end and a second end;

a plurality of signal wires forming a plurality of signal wire pairs disposed within said plug housing, said plurality of signal wires longitudinally extending from said first end to said second end of said plug;

a plurality of conductors positioned within said plug housing adjacent said first end and electrically connected with said plurality of signal wires, said conductors being arranged in a mutually spaced apart relationship; and a first and a second signal wire of a first signal wire pair, said first signal wire having a first portion crossing over a second signal wire pair such that said first signal wire is separated by said second signal wire by said second signal pair, and said second wire having a first portion extending substantially parallel to said plurality of signal wires and a second portion located between said second signal wire first portion and said conductors, said second signal wire second portion crossing over said second signal pair and said first signal wire such that a position of said first signal wire is switched with a position of said second signal wire whereby crosstalk in the plug is reduced.

19. The connector as defined in claim 18, further including a first wire management bar engagable with said plurality of signal wires, said first wire management bar maintaining said plurality of signal wires in a predetermined arrangement, and being positioned within said plug housing.

20. The connector as defined in claim 19, further including a second wire management bar being engagable with said plurality of signal wires for maintaining said plurality of signal wires in a predetermined arrangement, said first wire management bar positioned between said first signal wire crossing and said second signal wire crossing and said second wire management bar being positioned between said second signal wire crossing and said plurality of conductors.

21. The connector as defined in claim 18, wherein said plurality of signal wires are arranged in substantially parallel alignment at a position between said first signal wire crossing and said second signal wire crossing.

22. The connector as defined in claim 18, wherein said plurality of signal wires includes eight signal wires forming four differential signal pairs, said plurality of signal wires being positioned upon entering said second end of said plug such that signal wires forming each of said signal pairs is adjacently positioned.

23. An electrical plug connector assembly comprising:

a dielectric plug housing having a first end and a second end;

a plurality of signal wires forming a plurality of signal wire pairs disposed within said plug housing, said signal wires longitudinally extending from said first end to said second end of said plug;

a plurality of conductors positioned within said plug housing adjacent said first end and electrically connected with said plurality of signal wires, said conductors being arranged in a mutually spaced apart relationship;

a first signal wire of a first signal wire pair having a first portion crossing over at least one of said plurality of signal wires at a first crossing position located between said second and first end of the plug, and said first signal wire having a second portion crossing back over said at least one of said plurality of signal wires at a second crossing position located between said first crossing position and said plurality of conductors;

a first wire management bar engagable with said plurality of signal wires, said first wire management bar maintaining said plurality of signal wires in a predetermined spaced arrangement, and being positioned within said plug housing; and a second wire management bar being engagable with said plurality of signal wires for maintaining said plurality of signal wires in a predetermined spaced arrangement, said first wire management bar being positioned between said first and second signal wire crossing positions and said second wire management bar being positioned between said second crossing position and said plurality of conductors.

* * * * *

UNITED STATES PATENT AND TRADEMARK OFFICE

CERTIFICATE OF CORRECTION

PATENT NO. : 6,231,397 B1
DATED : May 15, 2001
INVENTOR(S) : de la Borbolla et al.

It is certified that error appears in the above-identified patent and that said Letters Patent is hereby corrected as shown below:

Title page,
Item [74], now read "Hoffman & Baron, LLP" should read -- Hoffmann & Baron, LLP --;

Column 19,
Lines 59-60, now reads "carrying elements is connected a conductive" should read -- carrying elements has a conductive --;

Column 20,
Line 52, now reads "first and second signal carrying conductive paths" should read -- first and second conductive paths --;
Lines 66-67, now reads "third and forth elements conductive" should read -- third and forth conductive --.

Signed and Sealed this

Eighth Day of January, 2002

*Attest:*

*Attesting Officer*

JAMES E. ROGAN
*Director of the United States Patent and Trademark Office*